US005591553A

United States Patent [19]

Snelling

[11] Patent Number: 5,591,553

[45] Date of Patent: Jan. 7, 1997

[54] FILTERED PHOTORECEPTOR

[75] Inventor: Christopher Snelling, Penfield, N.Y.

[73] Assignee: Xerox Corporation, Stamford, Conn.

[21] Appl. No.: 970,435

[22] Filed: Nov. 2, 1992

Related U.S. Application Data

[63] Continuation of Ser. No. 602,586, Oct. 24, 1990, abandoned.

[51] Int. Cl.[6] ..... G03G 5/12

[52] U.S. Cl. ..... 430/46; 430/42

[58] Field of Search ..... 430/42, 44, 46, 430/124

[56] References Cited

U.S. PATENT DOCUMENTS

| | | | |
|---|---|---|---|
| 3,212,887 | 10/1965 | Miller et al. | 430/46 |
| 4,081,277 | 3/1978 | Brault et al. | 96/38.2 |
| 4,121,932 | 10/1978 | Ishida | 96/1.2 |
| 4,124,384 | 11/1978 | Centa | 96/14 |
| 4,266,017 | 5/1981 | Martin et al. | 430/533 |
| 4,315,978 | 2/1982 | Hartman | 430/4 |
| 4,339,514 | 7/1982 | Biber | 430/7 |
| 4,345,011 | 8/1982 | Drexhage | 430/7 |
| 4,420,547 | 12/1983 | Nishikawa | 430/57 |
| 4,431,722 | 2/1984 | Takei et al. | 430/128 |
| 4,456,669 | 6/1984 | Yubakami et al. | 430/45 |
| 4,457,993 | 7/1984 | Nishikawa | 430/54 |
| 4,507,373 | 3/1985 | Tsilibes | 430/31 |
| 4,738,911 | 4/1988 | Haneda et al. | 430/46 |
| 4,764,444 | 8/1988 | Simons et al. | 430/47 |

OTHER PUBLICATIONS

*Electrophotography*, R. M. Schaffert, John Wiley & Sons, NY, pp. 466–472 (1975).

*New Riverside University Dictionary, Webster's*, Riverside Pub. Co., "Unitary", p. 1262; 1984.

"Fabrication of Color Filter Arrays for Solid–State Imagers by Laser Induced Dye Diffussion into Polymers", Journal of Imaging Science, 29/5), pp. 161–163, by R. O. Loutfy et al., Published Sep./Oct. 1985.

*Primary Examiner*—Christopher D. Rodee

[57] ABSTRACT

Disclosed is an electrophotographic imaging member that includes a substrate, a unitary electrophotographic insulating layer and a continuous phase having a transparent film forming polymer, the polymer phase having a surface facing away from the substrate, the surface facing away from the substrate contains imbibed dye molecules. The electrophotographic imaging member is prepared by subliming or vaporizing at least one sublimable or vaporizable dye on and into the surface of the layer facing away from the substrate. The invention also includes methods of forming multicolored or other images with this electrophotographic imaging member.

12 Claims, 10 Drawing Sheets

FILTERED PHOTORECEPTOR

This is a division of application Ser. No. 07/602,586, filed Oct. 24, 1990, abandoned.

BACKGROUND OF THE INVENTION

This invention relates in general to electrophotography and more specifically, to color imaging members and methods of making and using the imaging members.

Generally, electophotographic imaging processes involve the formation and development of electrostatic latent images on the imaging surface of an electrophotographic imaging member. The electrophotographic imaging member is usually imaged by uniformly electrostatically charging the imaging surface in the dark and exposing the member to a pattern of activating electromagnetic radiation such as light to selectively dissipate the charge in the illuminated areas of the member to form an electrostatic latent image on the imaging member surface. The electrostatic latent image is then developed with a developer composition containing toner particles which are attracted to the photoconductive member in image configuration. The resulting toner image is often transferred to a suitable receiving member such as paper and fixed thereto by any suitable technique such as thermal or pressure fusing. This imaging process may be repeated many times with reusable electrophotographic imaging members.

The electrophotographic imaging members include single or multiple layered devices comprising homogenous or heterogenous inorganic or organic compositions and the like. There have been disclosed layered photoreceptor devices comprising photogenerating layers and charge transport layers deposited on conductive substrates as described, for example, in U.S. Pat. No. 4,265,990. Electrophotographic devices known in the art also comprise, for example, a conductive substrate having deposited thereon a single layer comprising an organic photoconductor such as a polyvinylcarbazole-2,4,7-trifluorenone combination, phthalocyanines, quinacridones, pyrazolones and the like. These electrophotographic imaging members all contain at least one electrophotographic insulating material which is electrically insulating in the dark, but electrically conductive when struck by activating radiation.

Photoreceptor devices for color electrophotographic applications are well known and described, for example, in "Imaging Processes and Materials", Neblette's eight edition, Ed. J. Sturge, V. Walworth, A. Shepp, Van Nostrand Reinhold, New York, 1989, Chapter 5, Electrophotography, page 162. In one application for reproducing color images the photoreceptor is sensitive to electromagnetic radiation over the entire visible spectrum. The input color image is separated into three primary colors by appropriate external filters. This process involves three entirely separate latent image forming steps whereby the photoreceptor is sequentially exposed three times to the input image through typically three external color filters and developed stepwise by one of three color toners prior to transfer to paper. Exposure, development and transfer steps typically all occur for one colored toner prior to the next exposure. Three separate development systems, with the transfer of three colored toners are required to provide a full gamut of color. Disadvantages of this multicolor imaging process include the multiple light exposures required for forming the latent color image; the need for using external filters to control the spectral sensitivity of the photoreceptor device; the need for precise registration of the developer housings with respect to the latent image on the photoreceptor; and the need for precise registration of the developed toner patterns when they are transferred to the copy receiving sheet. The multiple light exposures required for latent image formation in the multicolor process have the additional disadvantages of consuming extra energy that powers the illuminant source and is time consuming, making the process slow compared to a single pass exposure process. Speed is also adversely affected if multiple development and transfer passess are required.

In another color photoreceptor application known as "highlight" or "accent" color, multilayer photoreceptor structures have been designed for single pass, two-color electrophotography, for example a black toner on white paper with a second highlight color toner according to Ishida et al as described in "Two Color Electrophotography", 4th International Conference on Electrophotography, Washington, D.C., p. 82. The Ishida et al photoreceptor consists of a conductive substrate, a lower photoconductive layer, an insulating layer in the middle and a photoconductive layer on top. The bottom and top photoconductive layers are chosen so that the lower layer is sensitive to light of wavelength less than 600 nm, while the upper layer is sensitive to wavelengths greater than 600 nm. The lower layer is sensitive only in the blue region of the spectrum. The middle layer may be an insulating polymer. The upper layer may be a polymeric organic photoconductor containing a dye that transmits blue and is sensitive in the red region of the spectrum. The photosensitization is a three step process involving sequential positive charging, negative charging in the dark and image exposure. The image is developed sequentially with a negatively charged colored toner followed by a black toner of opposite polarity. A problem with this two color process is cross contamination of the black toner by the colored toner leading to progressive deterioration of the black toner image quality in subsequently formed black toner images.

The application of dyestuffs in photosensitive members is known in the art for both single color and multi-color electrophotographic imaging processes. The dye or pigment in the photosensitive members of the prior art must serve to sensitize the photosensitive member, that is to promote and sustain the ionic charged state. For example copper phthalocyanine can be used as a photoconductor when incorporated into a polymeric binder to render the photoconductor photosensitive. Dyes have been used as sensitizers even in inorganic photoconductor materials to sensitize the xerographic plate to a larger segment of the visible spectrum. Many of the sensitizers used in photography are also applicable to xerography. Thus for example, crystal violet derivatives and cyanines are also useful sensitizers for electrophotographic imaging members. Organic pigments have also been vacuum deposited to form a photogenerating layer.

INFORMATION DISCLOSURE STATEMENT

In U.S. Pat. No. 4,081,277 to Brault, issued Mar. 28, 1978—a method for making a color imaging device is disclosed in which the device contains an array of charge-handling semiconductive photosensors and filter means for controlling the access of radiation to the array of photosensors. The filter means contains an array of filter elements comprising a polymeric dye receiving layer to which dyes have been heat transferred. The filter elements containing the heat transferred dyes can selectively absorb radiation from different portions of the spectrum.

In U.S. Pat. No. 4,266,017 to Martin et al. issued May 5, 1981—a color imaging device is disclosed comprising a means for sensing radiation using semi-conductive photosensors and a filter means for controlling the access of radiation to the photosensors. The filter means comprises a transparent polymer layer capable of receiving heat transferable dyes. The filter means is formed by patterning a photoresist layer on the polymer layer and heat-transferring a dye to the polymer layer.

In "Fabrication of Color Filter Arrays for Solid-State Imagers by Laser Induced Dye Diffusion into Polymers", *Journal of Imaging Science,* 29(5), page 161–163, by R. O. Loutfy et. al., published September/October 1985, a technique is described for fabricating color-filter-arrays for use in conjunction with solid-state imaging devices whereby selectively heating dye samples with thermally conductive, convective, or radiative means, for example with a laser, line and spot resolutions of about 10 micrometers or less are achieved.

In U.S. Pat. No. 4,420,547 to Nishikawa, issued Dec. 13, 1983—a photosensitive member for electophotography is disclosed comprising first and second photoconductive layers sequentially formed on a conductive layer. The first photoconductive layer has a spectral sensitivity extending over a range of light rays from ultraviolet to visible light. The second photoconductive layer atop the first is transparent to visible light, is formed with a single or a compound layer, has a filtering action to transmit only light of longer wavelengths and has a spectral sensitivity only to rays of shorter wavelengths to which the first photoconductive layer is insensitive. This device is constructed by dispersing an ultra-violet light absorbing dye compound, for example, into a transparent resin and depositing the resin-dye mixture onto the surface of the outermost, that is the top or second photoconductive, layer of the photosensitive member. This device is directed toward improving photo erasability, that is, the cancelling of charge on the photoreceptor using only light, and to the preservation of charged latent images by preventing charge leakage to the developer during continous multiple copy steps.

In U.S. Pat. No. 4,124,384 to Centa issued Nov. 7, 1978—an image reproduction process is disclosed which uses a photohardenable element containing photohardenable layers toned with a toner material comprising a sublimable dye. The process involves heating the above-stated toned layer while in contact with a receptor material, therefore causing the dye to sublime imagewise and condense on the receptor material. The receptor comprises polymer organic compounds.

In U.S. Pat. No. 4,315,978 to Hartmann, issued Feb. 16, 1982, and U.S. Pat. No. 4,339,514 to Biber, issued Jul. 13, 1982—a method is disclosed for providing single layer multicolor filter arrays on solid state devices such as silicon wafers or an array of charge coupled devices. In these patents, the color filter array is formed comprising: (1) exposing a light-sensitive layer of dichromated gel or diazo resin to a pattern of light, (2) washing away the unexposed gelatin or diazo composition forming dyeable islands, (3) dying the islands with a dye solution, and (4) covering the dyed islands with a thin dye-impermeable layer of nitrocellulose or photo cross-linkable barrier or a long chain fatty acid barrier layer which provides resistance to subsequent dyeing of a formed filter element set. The process is repeated to complete an ultra-fine array of alternating color stripes in the pattern red, green blue and so forth.

In U.S. Pat. No. 4,345,011 to Drexhage, issued Aug. 17, 1982—a method is disclosed for producing a planar array of color filter elements. In this method a suitably thin (less than 10 micrometers) color filter array is made by using cationic photo-bleachable dyes and sensitizer in transparent binder. Photographically exposing the layer to a desired pattern to photobleach the dye and fixing by leaching, the sensitizer gives individual filter elements having high optical transmission. In order to form a multicolor filter arrray, the transparent binder containing three photo-bleachable dyes is sequentially exposed to light through a mask representing the desired array of green, blue and red filters, respectively. The dyes are chosen so that those which absorb at longer wavelengths have lower bleaching efficienices than those which absorb at shorter wavelengths. This requirement is necessary to reduce the problem of dye-to-dye energy transfer on exposure.

In U.S. Pat. No. 4,456,669 to Yubakami et al., issued Jun. 26, 1984—an image forming process is disclosed utilizing heat-transferable dyes to form images on a receiving substrate. Image signals are used to arrange image forming particles on a support member. The particles contain a dye former which is heat-transferred onto an image receiving substrate. After heating, a color developing agent is used to adhere to the dye former to provide colored images.

In U.S. Pat. No. 4,121,932 to Ishida issued Oct. 24, 1978—an electrophotographic process is disclosed for forming a dye image. The process comprises an electrophotographic material containing a photoconductive layer consisting of photoconductive powders and sublimable dyes. The electrophotographic process further comprises charging a photosensitive element consisting of photoconductive particles and sublimable dyes, exposing and developing the element with acidic toners, heating the element to sublime the dyes and transferring the dye images to an accepting substrate.

In U.S. Pat. No. 4,431,722 to Takei issued Feb. 14, 1984—a photosensitive element for electrophotography is disclosed comprised of a layered structure having a previously sublimed polycyclic quinone pigment dispersed in an organic resin binder as a charge transport layer mixed with a resin binder.

The color imaging technique described above in U.S. Pat. No. 4,081,277 utilizes filter elements in a solid state photosensitive imaging member. The imaging member is not a xerographic photoreceptor but rather a direct, unitary, imaging device (e.g. sensor for video camera) incapable of making multiple prints in rapid succession.

As to U.S. Pat. Nos. 4,315,978, 4,335,076, and 4,339,514 described above, the covering of the dyed islands with a thin dye-impermeable layer of nitrocellulose or photo cross-linkable barrier or a long chain fatty acid barrier layer to provide resistance to subsequent dyeing of a formed filter element set creates problems. Many problems are associated with the barrier layers such as filter element float, electrical contact, careful application, and hardening and shrinking of the dyeable composition.

Color-infidelity, misalignment, and cross-talk continue to be problems with regard to the multicolor filter array system approach of U.S. Pat. No. 4,345,011, described above.

In U.S. Pat. No. 4,457,993 to Nishikawa, issued Jul. 3, 1984—an electrophotographic process is disclosed for forming multiple copies of an original on a photosensitive member comprising: simultaneous imagewise exposure of the original and charging the photosensitive member; uniform exposure of the photosensitive member so that the contrast of the charge image is below a maximum value; and restoring the charge image during the development and transfer.

While some of the above described imaging members exhibit certain desirable properties such as forming two or more colored images, there continues to be a need for improved electrophotographic imaging members having selective spectral sensitivities for color electrophotographic imaging applications. Further, there remains a need to provide color filter electrophotographic imaging members which are simple to fabricate. There also remains a need for electrophotographic imaging methods having enhanced security features which allow for the automatic detection or distinction between original or authentic documents and copies thereof. Also a need exists for convenient detection of unauthorized documents being copied either by simple visual inspection or by automatic optical or electronic document recognition schemes that employ internal filtered photoreceptor imaging members.

SUMMARY OF THE INVENTION

It is, therefore, an object of the present invention to provide an improved electrophotographic imaging system which overcomes the above-noted deficiencies.

It is another object of the present invention to provide an improved electrophotographic imaging system useful in electrophotographic imaging applications, particularly those involving imaging of two or more colors.

It is still another object of the present invention to provide an improved electrophotographic imaging system that affords the advantage of forming multicolor images from a single illumination step and multiple development steps.

It is yet another object of the present invention to provide an improved electrophotographic imaging system for forming color electrophotographic images without the need for external illuminant color filters.

It is another object of the present invention to provide an improved electrophotographic imaging system for controlling the spatial color exposure response of a photoreceptor thereby enabling selective development with color toners in only those areas appropriate for complimenting the color image response of the exposure step.

It is still another object of the present invention to provide an improved electrophotographic imaging system for preventing the copying of confidential documents by means of a selective color recognition scheme.

It is yet a further object of the present invention to provide an improved electrophotographic imaging system for preparing and imaging with a filtered photoreceptor device that "annotates" printed copies allowing convenient visual detection and distinction between original documents and copies of original documents.

It is still a further object of the present invention to provide an improved electrophotographic imaging system that provides benefits as a fatigue effect filter that protects and extends the useful life of photoreceptor devices by retaining the photosensitive character and the electrical properties of the filtered photoreceptor after extensive cycling and exposure to normally deleterious ambient environmental conditions, such as oxygen, ozone, ultraviolet radiation, and elevated temperatures.

The foregoing objects as well as other objects are accomplished by the present invention by providing an electrophotographic imaging member comprising a substrate, a unitary electrophotographic insulating layer and a continuous phase comprising a transparent film forming polymer, the polymer phase having a surface facing away from the substrate, the surface facing away from the substrate comprising imbibed dye molecules. The electrophotographic imaging member is prepared by subliming or vaporizing at least one sublimable or vaporizable dye on and into the surface of the layer facing away from the substrate while maintaining the layer at a temperature conducive for the diffusion of dye molecules into the layer. The present invention also includes various methods of forming multicolored or other images with this electrophotographic imaging member.

Generally, the electrophotographic imaging member of this invention comprises at least one unitary photoconductive layer. The photoconductive members include single or multiple layered devices comprising homogeneous or heterogeneous inorganic or organic compositions and the like. The layer comprising the transparent film forming polymer may be located in a photoconductive layer or some other layer overlying the photoconductive layer.

Any suitable electrophotoconductive imaging member comprising a substrate, a unitary electrophotographic insulating layer and a transparent film forming polymer may be utilized with the sublimed or vaporized dye molecules. Generally, an electrophotoconductive imaging member comprises one or more photoconductive layers on a supporting substrate. These layers are unitary, continuous and normally extend over all or almost all of the substrate The substrate may be opaque or substantially transparent and may comprise numerous suitable materials having the required mechanical properties. Accordingly, this substrate may comprise a layer of a non-conductive or conductive material such as an inorganic or an organic composition. If the substrate comprises non-conductive material, it is usually coated with a conductive composition. As insulating non-conducting materials there may be employed various film forming resins known for this purpose including, for example, polyesters, polycarbonates, polyamides, polyurethanes, and the like. The insulating or conductive substrate may be flexible or rigid and may have any number of many different configurations such as, for example, a plate, a cylindrical drum, a scroll, an endless flexible belt, and the like. Thus, a typical substrate may comprise an insulating substrate in the form of an endless flexible belt comprised of a commercially available polyethylene terephthalate polyester known as Mylar available from E. I. du Pont de Nemours & Co. The thickness of the substrate layer depends on numerous factors, including economical considerations, and thus this layer may be of substantial thickness, for example, over 200 micrometers, or of minimum thickness less than 50 micrometers, provided there are no adverse affects on the final photoconductive device. A conductive layer or ground plane which may comprise the entire support or be present as a coating on a non-conductive layer may comprise any suitable material including, for example, aluminum, titanium, nickel, chromium, brass, gold, stainless steel, carbon black, graphite and the like. The conductive layer may vary in thickness over substantially wide ranges depending on the desired use of the electrophotoconductive member. Accordingly, the conductive layer can generally range in thickness of from about 5 nanometers to many centimeters. When a flexible photoresponsive imaging device is desired, the thickness of the conductive layer may be between about 10 nanometers to about 75 nanometers and more preferably from about 10 nanometers to about 20 nanometers.

After formation of an electrically conductive surface, an optional hole blocking layer may be applied thereto. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may comprise, for example, nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,291,110, 4,338,387, 4,286,033 and 4,291,110. The disclosures of U.S. Pat. Nos. 4,338,387, 4,286,033 and 4,291,110 are incorporated herein in their entirety. A preferred blocking layer comprises a reaction product between a hydrolyzed silane and the oxidized surface of a metal ground plane layer. The oxidized surface inherently forms on the outer surface of most metal ground plane layers when exposed to air after deposition. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. The blocking layer should be continuous and have a thickness of less than about 0.2 micrometer because greater thicknesses may lead to undesirably high residual voltage.

An optional adhesive layer may applied to the hole blocking layer. Any suitable adhesive layer well known in the art may be utilized. Typical adhesive layer materials include, for example, polyesters, dupont 49,000 (available from E. I. dupont de Nemours and Company), Vitel PE 100 (available from Goodyear Tire & Rubber), polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infrared radiation drying, air drying and the like.

Any suitable unitary electrophotographic insulating layer or layers may be utilized in the electrophotographic imaging member of this invention. The unitary photoconductive layer or layers may be inorganic or organic and homogeneous or heterogeneous. Typical inorganic photoconductive materials include well known materials such as amorphous selenium, selenium alloys, halogen-doped selenium alloys such as selenium-tellurium, selenium-tellurium-arsenic, selenium-arsenic, and the like, cadmium sulfoselenide, cadmium selenide, cadmium sulfide, zinc oxide, titanium dioxide and the like. Typical organic photoconductors include phthalocyanines, quinacridones, pyrazolones, polyvinylcarbazole-2,4,7-trinitrofluorenone, anthracene and the like. Many inorganic or organic photoconductors may be used as particles dispersed in a resin binder or as a homogeneous layer.

Any suitable electrophotographic imaging member comprising a unitary single electrophotoconductive insulating layer may be used in the present invention. The single layer photoconductors comprise only one electrophotoconductive insulating layer. If the single photoconductive layer comprises a transparent film forming resin, the surface facing away from the substrate may be imbibed with a sublimed or vaporized dye. Whether the single layer photoconductive layer comprises a transparent film forming resin or is free of a transparent film forming resin, an overcoating comprising a transparent film forming resin may be applied to the photoconductive layer and the surface of the overcoating facing away from both the substrate and the photoconductive layer may be imbibed with a sublimed or vaporized dye.

While a single layer photoreceptor device may be used in forming the filtered photoreceptor of the present invention, a photoconductive member having at least two electrically active layers, e.g. a unitary photogenerating or charge generating layer and a charge transport layer, is preferred. One of the electrically active layers is a charge generating layer comprising photoconductive material which is capable of photogenerating and transferring electrical charge to the adjacent electrically active transport layer. Another of the electrically active layers is a charge transporting layer which is substantially nonabsorbing in the spectral region of the intended use, but is active in that it is capable of transporting charge carriers injected by the charge generating layer. Any suitable multilayer photoconductor may also be employed in the present invention. Examples of photogenerating materials for photogenerating layers include, for example, trigonal selenium, various phthalocyanine pigments such as the X-form of metal free phthalocyanine described in U.S. Pat. No. 3,357,989, metal phthalocyanines such as copper phthalocyanine, quinacridones available from DuPont under the tradename Monastral Red, Monastrai Violet and Monastral Red Y, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange and the like. The photogenerating layer containing photoconductive compositions and/or pigments and the film forming polymeric binder material generally ranges in thickness of from about 0.1 micrometer to about 5 micrometers, and preferably has a thickness of from about 0.3 micrometer to about 1 micrometer. Thicknesses outside these ranges can be selected providing the objectives of the present invention are achieved.

Any suitable charge transport molecule capable of acting as a film forming binder or which is soluble or dispersible on a molecular scale in a film forming binder may be utilized in the continous phase of the charge transport layer resin. The charge transport molecule should be capable of transporting charge carriers injected by the charge generating layer. The charge transport molecules may be hole transport molecules or electron transport molecules. Where the charge transport molecule is capable of acting as a film forming binder, as indicated above, it may if desired, be employed without the necessity of incorporating a different charge transport molecule in solid solution or as a molecular dispersion therein. Charge transporting materials are well known in the art. In addition to the film forming polymers having charge transport capabilities listed above, a partial listing representative of non film forming charge transporting materials include the following:

Diamine transport molecules of the types described in U.S. Pat. Nos. 4,306,008, 4,304,829, 4,233,384, 4,115,116, 4,299,897, 4,265,990 and 4,081,274. Typical diamine transport molecules include N,N'-diphenyl-N,N'-bis(alkylphenyl)-[1,1'-biphenyl]-4,4'-diamine wherein the alkyl is, for example, methyl, ethyl, propyl, n-butyl, etc. such as N,N'-diphenyl-N,N'-bis(3"-methylphenyl)-[1,1'-biphenyl]-4,4'-diamine, N,N'-diphenyl-N,N'-bis(4-methylphenyl)-[1,1'-biphenyl]-4,4'-diamine, N,N'-diphenyl-N,N'-bis2-methylphenyl)-[1,1'-biphenyl]-4,4'-diamine, N,N'-diphenyl-N,N'-bis(3-ethylphenyl)-[1,1'-biphenyl]-4,4'-diamine, N,N'-diphenyl-N,N'-bis(4-ethylphenyl)-[1,1'-biphenyl]-4,4'-diamine, N,N'-diphenyl-N,N'-bis(4-n-butylphenyl)-[1,1'-biphenyl]-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Hydrazone transport molecules such as p-diethylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), p-dimethylaminobenzatdehyde-(diphenylhydrazone) and the like described, for example in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and other hydrazone transport molecules described, for example in U.S. Pat. Nos. 4,385,106, 4,338,388, 4,387,147, 4,399,208, and 4,399,207.

Still other transport molecules including 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and other suitable carbazole phenyl hydrazone transport molecules described, for example, in U.S. Pat. No. 4,256,821. Similar hydrazone transport molecules are described, for example, in U.S. Pat. No. 4,297,426.

Other typical transport materials include the numerous transparent organic non-polymeric transport materials described in U.S. Pat. No. 3,870,516 and the nonionic compounds described in U.S. Pat. No. 4,346,157.

The disclosures of each of the patents identified above pertaining to charge transport molecules which are soluble or dispersible on a molecular scale in a film forming binder are incorporated herein by reference in their entirety.

Generally, the thickness of the transport layer is between about micrometers and about 100 micrometers, but thicknesses outside this range can also be used. The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1.

Examples of photosensitive members having at least two electrically active layers include the charge generator layer and diamine containing transport layer members disclosed in U.S. Pat. Nos. 4,265,990, 4,233,384, 4,306,008, and 4,299,897; dyestuff generator layer and oxadiazole, pyrazalone, imidazole, bromopyrene, nitrofluourene and nitronaphthalimide derivative containing charge transport layers members disclosed in U.S. Pat. No. 3,895,944; generator layer and hydrazone containing charge transport layers members disclosed in U.S. Pat. No. 4,150,987; generator layer and a tri-aryl pyrazoline compound containing charge transport layer members disclosed in U.S. Pat. No. 3,837,851; generator layer and a charge transporting polyarylamine layer containing members disclosed in U.S. Pat. No. 4,806,433; and the like. The disclosures of these multiple electrically active layer patents are incorporated herein in their entirety.

The single or multilayered photoreceptors may be overcoated with an optional protective coating having a continuous phase comprising a polymeric film forming binder that is substantially transparent to activating radiation to which the photoconductive layer is sensitive. Overcoatings are electrically insulating or slightly semi-conductive. They are also continuous and generally have a thickness of less than about 10 micrometers. Overcoatings are well known in the art. A typical overcoating is described in U.S. Pat. No. 4,515,882, the entire disclosure of which is incorporated herein by reference. One method of preparing a filtered overcoated electrophotographic imaging device of the present invention comprises fabrication of a prior art electrophotographic imaging member as described in the working examples of the aforementioned U.S. Pat. No. 4,265,990 followed by thermal sublimation of a thin dye layer onto and into the surface of the resin based charge transport layer followed by the optional application of an overcoating on the dye modified photoreceptor member.

Any suitable electrically insulating polymeric film forming binder having a very high dielectric strength and good electrically insulating properties may be used in the continuous phase of a heterogeneous single layer photoconductor, a charge transporting layer of a multi-layer photoreceptor or a thin protective overcoating. The film forming polymeric binder itself may be a charge transporting material. If the film forming polymeric binder itself is not a charge transporting material, it should be capable of holding transport molecules in solid solution or as a molecular dispersion if the polymeric binder is employed as the binder in the continuous phase of a charge transporting layer. A molecular dispersion is defined as a composition in which particles of at least one component are dispersed in another component, the dispersion of the particles being on a molecular scale. Generally, the film forming polymeric binders used in the continous phase are substantially non-absorbing in the spectral region of the intended use. Typical film forming polymeric binder materials that are not charge transporting materials include, for example, thermoplastic and thermosetting resins such as polycarbonates, polyesters, polyamides, polyurethanes, polystyrenes, polyarylethers, polyarylsulfones, polybutadienes, polysulfones, polyethersulfones, polkyethylenes, polypropylenes, poyimides, polymethylpentenes, polyphenylene sulfides, polyvinyl acetate. polysiloxanes, polyacrylates, polyvinylacetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amide-imide), styrene-butadiene copolymer, vinylacetate-vinylidenechloride copolymers, styrene-alkyd resins, and the like.

As described above, charge transporting film forming polymers are known in the art. Typical film forming binder materials that are charge transporting materials include, for example, the film forming polymers prepared from diphenyl diamines, for example triphenyl methane polyamines and the like; polyvinylcarbazole and derivatives of Lewis acids described in U.S. Pat. No. 4,302,521; vinyl-aromatic polymers such as polyvinyl anthracene, polyacenaphthalene; formaldehyde condensation products with various aromatics such as condensates of formaldehyde and 3-bromopyrene; polyarylamines described in U.S. Pat. No. 4,806,433 and the like. The disclosures of these charge transporting polymer patents are incorporated herein in their entirety.

The charge transporting polymer, if employed, or the combination of film forming polymeric binder and small molecule charge transport material in the charge transporting, continuous phase should have an electrical resistivity at I east about $10^{13}$ ohm-cm. The charge transporting, continuous phase should also be capable of forming a continous film and be substantially transparent to activating radiation to which the underlying photoconductive material is sensitive. In other words, the transmitted activating radiation should be capable of generating charge carriers, i.e. electron-hole pairs in the photoconductive material.

Where the surface of a layer containing the film forming polymeric binder phase is to be imbibed with a dye, the polymer should be transparent through the visible spectrum, have good dye absorbing characteristics, good adhesion characteristics to the substrata, and be thermally and chemically stable. The polymer is preferably solvent-coatable, although laminated or extruded polymers may also be suitable. Typical resins that satisfy these requirements include polycarbonate, polyvinylacetate, polyester (e.g. Vitel PE-200, available from Goodyear Chemical Division of Goodyear Tire and Rubber Co. and du Pont 49000 available from E. I. dupont de Nemours & Co.), polymethylmethyacrylate, polyethylene terephthalate, cellulose acetate, and the like.

The layers of the electrophotographic imaging member may be formed by any suitable well known technique. Typical coating techniques include spraying, draw bar coating, dip coating, gravure coating, silk screening, air knife coating, reverse roll coating, extrusion techniques and the like. Any suitable conventional drying or curing technique may be utilized to dry the layers. The drying or curing conditions should be selected to avoid damaging the applied layer or any underlying layer. For example, the layer drying temperatures should not cause crystallization of amorphous selenium when an underlying amorphous selenium photoconductive insulating layer is used.

Any suitable dye which either sublimes or has a high vapor pressure may be used in the processes of this invention. Various classes of dyes including, for example, azo, anthraquinone, indophenol, indoaniline, perinone, quinophthalone, acridine, xanthone, diazine, and oxazine dyes can be diffused into the dye receiving layer described above. A partial list of such dyes useful for making color imaging devices of the present invention include, for example: Eastman Fast Yellow 8GLF, Eastman Brilliant Red FFBL, Eastman Blue GBN, Eastman Polyester Orange 2RL, Eastman Polyester Yellow GLW, Eastman Polyester Dark Orange RL, Eastman Polyester Pink RL, Eastman Polyester Yellow 5GLS, Eastman Polyester Red 2G, Eastman Polyester Blue GP, Eastman Polyester Blue RL, Eastone Yellow R-GFD, Eastone Red B, Eastone Red R, Eastone Yellow 6GN, Eastone Orange 2R, Eastone Orange 3R, Eastone Orange GRN, Eastman Red 901, Eastman Polyester Blue 4RL, Eastman Polyester Red B-LSW, Eastman Turquoise 4G, Eastman Polyester Blue BN-LSW, (all available from the Eastman Kodak Co., Rochester, N.Y.). Other dyes useful in the process of making and using this invention include magenta, ICI Disperse Red; yellow, cyan, DuPont Disperse Blue 60; red, Bayer Resiren Red TB; and green, Bayer Macrolex G and the like. The dye should be thermally and chemically stable, compatible with the film forming polymers, color fast, have low specific heat of from about 1.5 to about 2 Joules per gram-degree Centigrade, and low latent heat of fusion of from about 20 to about 150 Joules per gram. The melting point of these dyes range from about 150° C. to 250° C. Melting points outside these ranges can be selected providing the objectives of the present invention are achieved. Preferred dyes have a specific heat of about 1.8 Joules per gram-degree Centigrade and have a latent heat of fusion between 30 and 120 Joules per gram. All of these dyes sublime easily and uniformly imbibe when deposited upon a layer having a suitable continuous film forming polymer phase. Some of the dyes described above are also disclosed in U.S. Pat. No. 4,081,277 to Brault, the entire disclosure therein being incorporated herein by reference.

Generally, any suitable technique may be employed to apply a sublimable dye or dye having a high vapor pressure to the surface of the layer containing the film forming polymeric binder phase to be imbibed with the dye. The expression "imbibe" is defined herein as the absorbing and taking into solid solution of the sublimed or vaporized dye by the film forming polymeric binder phase. The dye is heated at a first location to form vapors and the resulting vapors are transferred from the original location to the surface of the layer containing the film forming polymeric binder phase to be imbibed with the dye. The surface treated with the dye is the surface facing away from the underlying substrate. During the deposition of the dye, the temperature of the layer containing the film forming polymeric binder phase being imbibed with the dye is maintained at a temperature below the condensation or sublimation temperature of the dye. The film forming polymer should be capable of softening and remaining soft throughout the dye diffusion transfer process. Preferably, after transfer, the film forming polymeric binder phase should contain, at and adjacent to the surface facing away from the underlying substrate, a zone or region containing from about 0.01 percent and about 5.0 percent by weight of bulk dissolved dye molecules, based on the total weight of the film forming polymeric binder in the zone or region containing the imbibed dye. Also, the dyed or filter regions should be thermally and mechanically stable. If desired, a partial vacuum may be employed while the dye is being applied to the layer containing the film forming polymeric binder phase to facilitate diffusion of the dye from the donor to the receiver. The amount of partial vacuum that may be applied varies with the specific dye employed and the temperature sensitivities of the materials utilized.

Any suitable source may be used as a source of the dye that is diffused. Typical sources include donor sheets, crucibles, cylinders, ribbons, and the like. An example of a suitable dye donor sheet is the 3M Color-in-Color dye donor sheets used with the 3M color copier, Model 137 BZ (1972). The dye may be applied uniformly to the entire exposed surface of the layer containing the film forming polymeric binder phase to be imbibed with the dye or it can be applied in a pattern or "patches". The pattern may be of any suitable shape. The zone of dissolved dye molecules is sufficiently thick to control the spectral sensitivity of the underlying photoconductive material. Control of spectral sensitivity is defined herein as substantially blocking electromagnetic radiation within a desired wavelength band to prevent that wavelength band from activating the underlying photogenerating material. The dye density is preferably uniform laterally across the dyed zone, whether such zone covers the entire surface of the dyed layer or only a patch or patches. When used as a patch filter, the dyed patches should have low patch to patch or panel to panel density variations. Typical patch shapes include circles, squares, rectangles, ovals, stars, hexagons, triangles, stripes, and the like. The shapes may be regular or irregular. If a pattern of imbibed dye is employed, the pattern may be of any suitable size, the selected size depending on the intended use of the final electrophotographic imaging member. Typical shape sizes include spots having an average size between about 1000 nanometers and about 1 centimeter in diameter or stripes having a width of between about 1000 nanometers and about 1 centimeter and a length of between about 1000 nanometers and about 1000 centimeters. Moreover, a plurality of patterns may be applied using a plurality of different dyes, each having the same or different color or light filtering property. The dye patterns may be formed by any suitable technique. Typical techniques for forming dye patterns include using a mask or stencil between the dye source and the film forming polymeric binder phase to be imbibed with the dye and heating the dye uniformly; employing a dye donor sheet that carries the dye in a preformed pattern and heating the donor sheet uniformly; utilizing a dye donor sheet uniformly coated with a dye and applying heat to the donor sheet in a pattern corresponding to the dye pattern to be formed; and the like. The source of the dye that is vaporized or diffused may be spaced away from or in contact with the layer containing the film forming polymeric binder phase to be imbibed with the dye. When dyes of different colors are applied, the different colors may be applied sequentially or simultaneously. An example of simultaneous deposition involves contacting the layer containing the film forming polymeric binder phase with a donor sheet bearing all the different dyes in separate locations on the surface of the donor sheet in accordance with a predetermined pattern and heating the donor sheet uniformly to vaporize all the dyes at the same time thereby forming an imbibed pattern wherein different colored dyes are imbibed in different locations on the layer in accordance with the pattern on the donor sheet. Depending upon the color imaging requirements of the final toner images, the dye combinations may be of any suitable colors such as, for example, cyan, magenta, yellow, red, blue or green, brown, orange, purple and the like.

Any suitable technique may be employed to heat and vaporize the dye. Typical heating processes include, infrared heating, laser heating, oven heating, forced air heating, and the like. As described above, the dye should be heated to a temperature sufficient to vaporize or diffuse the dye. The temperature range used in heating the dye, defined herein as the "transfer temperature", is above the sublimation or vaporization temperature of the dye to be transferred, is at least about 20° C. but below decomposition temperatures of the dyes and other photoreceptor components, is below the temperature at which the charging and transport properties of the photoreceptor degrade or deteriorate, and is sufficiently high to achieve satisfactory diffusive transfer and penetration of the dye into the transport or polymeric top layer. Thus, for example a transfer temperature from about 50° to about 300° C., and preferably from 100° C. to about 250° C. is satisfactory at ambient atmospheric pressure. The use of reduced pressure conditions in the sublimation or vaporization process provides for a substantial reduction in the temperatures required for successful transfer. Since the layer containing the film forming polymeric binder phase to be imbibed with the dye should be maintained at a temperature sufficient to condense or solidify the dye vapor, it can, if desired, be cooled by any suitable conduction or convection means such as, for example, a thermally conductive metal heat sink or water cooled platten. Thereafter, the dye treated imaging member may optionally be washed with solvent to remove excess or physi-sorbed dye, that is, excess non-imbibed dye molecules. An illustrative example of the preparation of a filtered photoreceptor includes holding an offset printed pattern of a sublimable dye on a support sheet (dye donor) in close contact with a well known photoreceptor transport layer of a photoreceptor on an aluminized Mylar film, for example, as described in the aformentioned U.S. Pat. No. 4,265,990, and heating the dye donor with a hand iron to sublime the dye and diffusively imbibe it into the adjacent surface of the transport layer.

As described above, the dye is imbibed into the surface of a layer comprising a polymeric film forming binder in the continuous phase of a heterogeneous single layer photoconductor, a charge transporting layer of a multi-layer photoreceptor or a thin protective overcoating. The surface treated with the dye is the surface facing a way from the underlying substrate. In some embodiments, one or more transparent layers may subsequently be applied over the layer bearing the dye imbibed surface. For example, the dye treated surface of the continuous phase of a heterogeneous single layer photoconductor may be overcoated with a protective overcoating; or the dye treated surface of a charge transporting layer of a multi-layer photoreceptor may coated with a thin protective overcoating; or the dye treated surface of a heterogeneous charge generating layer of a multi-layer photoreceptor may be coated with a charge transporting layer. A multi-layer photoreceptor may also be fabricated wherein one or more polymer receiving layers containing one or more imbibed dye compounds. Thus, an important feature of the process of forming the imaging member of the instant invention is the sublimation diffusion or vaporization of dye molecules by uniformly or selectively heating a dye donor member by various thermal methods and thereby facilitating sublimation diffusion or vaporization transfer of dye molecules to the receiving polymer containing surface of a photoreceptor layer. The sublimation transfer process may be controlled and limited by directing the dye to the photoreceptor layer surface in a selective manner using any suitable means such as an intermediate mask or stencil layer that is situated between the dye donor member and the dye receiving layer. In this way it is possible to form various patterns that are of value in forming multicolored images and also for forming image enhancements, such as informational background character images or highlight color characters or graphical patterns.

The diffusion of dyes into a receiving polymer may be accomplished by the action of a laser beam to form high resolution dyed filter patches or regions with a broad selection of suitable sublimable or high vapor pressure dyes and film forming polymers. Laser induced dye diffusion into polymers has been used in optical disc technology, known as laser induced dye amplification. The concept of laser induced dye amplification is based on the principle of simultaneously exposing and fixing an image by inducing dye diffusion from a dye coated member onto the image substrate. The laser energy is absorbed by the dye which subsequently vaporizes and diffuses into the substrate to give an image in the form of a color panel or color patch element depending upon the pattern selected. Dye appearing in the non-exposed areas inadvertently from mechanical transfer may be removed with solvent and thereby affords the final set of internal color filtered photoreceptor elements. Where laser heating is utilized to facilitate the dye transfer, the process depends upon the transformation of laser excitation energy to heat. Thus, those dyes of the present invention used with laser deposition should possess high efficiency of nonradiative deactivation. The laser photon energy is converted to heat energy within the dye molecules. The laser excited dye molecules should have low propensity toward dissipating the excitation energy by a radiative pathway. All the dyes used in the laser deposition technique should exhibit a low yield of luminescence of less than about 10 percent. The diffusion of a sublimed dye molecules into the surface of a dye receiving polymer receiving layer is achieved in one preferred embodiment by exposing the dye donor member sheet to a focused laser beam. Any undiffused dye-film deposited on the polymer containing layer may be subsequently removed by any suitable solvent for the dye. The solvent should not adversely affect the polymer layer or the polymer layer containing the imbibed dye. Typical solvents include, for example, alcohols, ethers, and the like. What remains on the polymer is only the desired dye-in-polymer hybrid color filter pattern. Preferably, dye molecules dissolved and removed by the solvent do not contaminate areas on the polymer that are to be free of imbibed dye. The shape, size and position of color filters is determined by the scanning laser beam pattern and the geometry of the mask member selected. For example, color filters of about 10 micrometers in diameter of yellow, cyan, magenta, red, blue, and green and the like are made with good uniformity, edge sharpness and color fastness using a focused scanning laser beam. The laser energy applied should be sufficent to sublimate or otherwise vaporize the dye and diffuse it into the surface of the polymer layer. No visual or performance damage to the photoreceptor is evident from laser pulses of 300 times greater energy than the minimum required for dye diffusion.

In yet another embodiment for making the imaging member of the present invention the steps include (1) applying a thin polymer film, typically about 2 micrometers to 3 micrometers thick, onto a preformed polymeric film forming binder in the continuous phase of a heterogeneous single layer photoconductor or a charge transporting layer of a multi-layer photoreceptor, (2) vacuum depositing a thin dye layer typically from about 0.2 micrometers to about 0.5 micrometers onto the thin polymer film, (3) subjecting the dye layer on the polymer layer to a series of focused laser pulses with the appropriate energy, dimensions and position causing dye diffusion into the thin polymer film, and (4) removing the dye unexposed to the laser beam with a solvent from the dye layer but not from the polymer film to obtain a pattern of chromatic filter elements. Alternatively, uniform dye treatment over the entire exposed polymer layer surface yields a filtered photoreceptor that is responsive only to wavelengths of the light spectrum which are not substantially absorbed by the imbibed dye molecules.

One method of forming thermally transfered dye images that is well known in the art is the printing of colored patterned garments in the textile arts and, for example, for direct formation of color images printed on paper substrates. However, the application of dyes to preformed layers of photoreceptors for the purpose of forming internally filtered photoreceptor devices is believed to be new, particularly patterned internally filtered photoreceptors for the purpose of single illumination multicolor xerographic imaging. A preferred technique for fabricating the color filtered photoreceptor of this invention is to sublime, for example, disperse dyes into the exposed surface layer using technology similar to that used for heat transfer printing of fabrics. Disperse dyes may be in any of three distinct classes: nitroarylamine; azo; and anthraqinone; most containing amino or substituted amino groups but absent are water solubilizing sulfonic acid groups. The dyes are typically introduced to a non-absorbant fiber or plastic receiving sheet as a dispersion or colloidal suspension in water. The resultant coated sheet is dried to remove water and is thereafter used in the filtered photoreceptor fabrication process in one embodiment of the present invention. By selectively heating with thermally conductive, convective, or radiative means, for example with a laser, line and spot resolutions of about 10 micrometers or less are achieved, as has been for example shown for the fabrication of a related but non-xerographic photosensitve imaging member in "Fabrication of Color Filter Arrays for Solid-State Imagers by Laser Induced Dye Diffusion into Polymers", *Journal of Imaging Science,* 29(5), page 161–163, September/October 1985, and which is incorporated herein in its entirety by reference.

The electrophotographic imaging member of this invention may be utilized in an electrophotographic imaging process in which the imaging member is uniformly electrostatically charged, exposed to activating radiation in image configuration to form at least one electrostatic latent image and developed with toner particles. The imbibed dye molecules are capable of selective spectral filtering of the photoreceptor imaging characteristics while retaining comparable electrical properties as found in the original dye unmodified photoreceptor. In other words, the photoreceptor of this invention can contain an integral array of finely dispersed color filter elements or patches superimposed in a fully functional and operative photoreceptor device. These filter elements taken together provide for an imaging member that may be selectively imaged when exposed to visible light and subsequently selectively developed to produce colored electrophotographic images. The filtered photoreceptor process can combine a photoreceptor having spatially controlled color exposure response with an area controlled development subsystem. When used in combination these elements can provide a single exposure pass multicolor copying process. The electrophotographic imaging member of the instant invention may be employed in color electophotographic imaging processes wherein the outer imaging surface is uniformly charged in the dark. Charging may be followed by exposing the dye modified imaging member to visible light in a single illumination event causing discharge of the photoreceptor in non-image areas with color separation occuring in the image areas according to the internal dye color filters. The latent image may then selectively developed with colored dry or liquid toners to form a toned image with separate and sequential area development processes that correspond to the internal dye color filter. Generally, toners of the subtractive primary colors cyan, magenta, and yellow are used to develop filtered photoreceptor areas having red, green and blue color filter properties, respectively. Any suitable well known, conventional toners may be utilized. The toned images may then be tranferred to a print receiving member, for example a paper sheet, and fixed to the sheet by suitable means such as by heat or pressure. Thus, in one embodiment within the scope of the present invention, color separation and xerographic color development can occur to the extent that the unexposed charged areas corresponding to light filtered imbibed dye patterns on the photoreceptor discriminate and resolve incident visible radiation. That is, if a particular filtered region is sensitive to the incident radiation, it will be discharged and subsequently will not be developed by the charged toner. If the filtered region is insensitive to the incident radiation, then this filtered region will remain charged and will be developed by a colored toner according to the sequence of developer color application, for example: yellow, cyan then magenta. Generally, the smaller the dimensions of the filtered regions, for example of about 10 micrometers in diameter or width, and the greater the dispersion of filtered regions, for example all adjacent filtered regions are of different color sensitivities, or in the alternative, no two adjacent filter regions are of the same color, color images of the highest quality are produced. Thus, the process of the present invention is suitable for preparing internal color filtered photoreceptor elements having dimensions as small as 10×10 micrometers and smaller. This color imaging process is simpler than conventional color copying process such as used in the Xerox 6500® machine where it is necessary to physically switch-in or interchange the different color filters of red-green-blue at appropriate times for proper cyan-magenta-yellow developments, respectively. By masking specific panels of the photoreceptor for internal self filtering, that is uniform filters of, for example, red-green-blue, external filters and their associated activation and timing mechanics needed for proper synchronization are eliminated with one embodiment of the photoreceptors of this invention. In one embodiment the dye imbibed color panels are square or rectangular in shape and are from about 1000 nanometers to about 1 centimeter wide. In another embodiment the colored panels are circular shape and are from about 1000 nanometers to about 1 centimeter in diameter. Particularly preferred geometries for filtered photoreceptor panels or regions are close-packed circles or squares that are nominally about 10 microns wide. However, other shapes may be employed as desired such as elipsoidal, trapezoidal, star, circle, square, rectangle, oval, hexagon, triangle shapes and the like and having an average size of between about 1000 nanometers and about 1 centimeter. If stripes or panels are employed the widths are preferably between about 10 micrometers and 100 micrometers.

By appropriate selection of the absorption frequency of the dye imbibed, a narrow spectral "stop" band wavelength filter can be built into a photoreceptor to stop or prevent copying of classified original documents printed on colored paper stock or having colored text or images corresponding to a narrow spectral "stop-band" wavelength filter. In other words, by using an internal dye imbibed filtered photoreceptor having a narrow "stop" band, documents with background area colors, text or images of wavelengths in the "stop" band spectral region cannot be copied. Thus, the "stop" band corresponds to the spectrally non-responsive dyed regions of the filtered photoreceptor so that, after exposure, the photoreceptor remains charged in the areas which correspond to both the image and background areas of the original. This capability may be achieved with a conventional external filter means, however by using a filtered photoreceptor an additional advantage is realized in that it is not easy to disable the internal filter means and defeat the security feature without disabling the reprographic capability of the photoreceptor.

In still another embodiment of this invention the internal filter may be utilized to protect and thereby extend the useful working lifetime of conventional photoreceptors. It is well known in the art of photoreceptor devices that multilayered photoreceptors can suffer from a fatigue effect due to exposure to ambient ultraviolet illumination. Use of a blue absorbing imbibed dye filter material, for example a multilayered photoreceptor treated with the aforementioned yellow dye, is an effective means to reduce the fatigue effect from ultraviolet radiation thereby enhancing the useful service life of the photoreceptor without interfering with the useful wavelength gamut required for imaging.

The advantages of the dye modified filtered photoreceptor structure and methods of imaging will become apparent upon consideration of the following disclosure of the invention, particularly when taken in conjunction with the accompanying drawings.

Figure 6A:
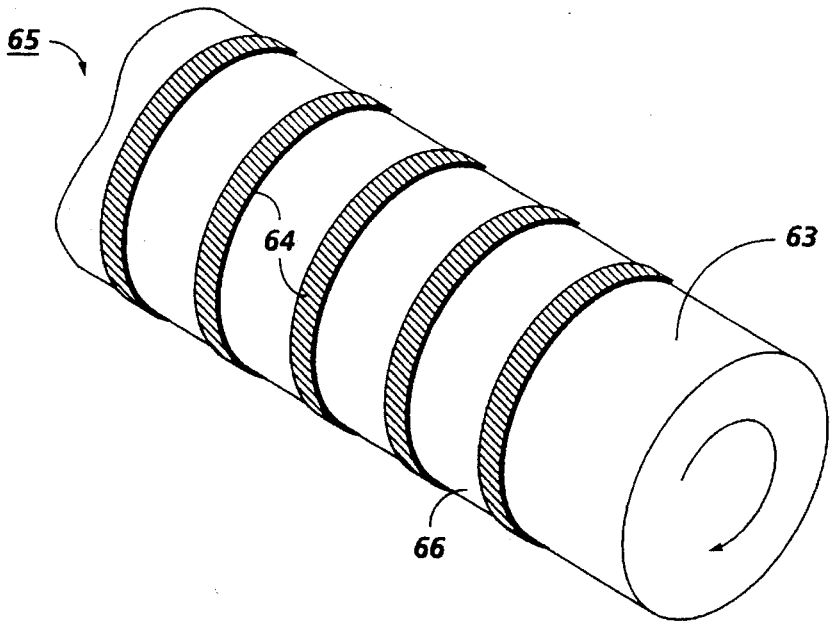

FIGS. 6A and B illustrate an embodiment for making and using a device of the instant invention.

Figure 7A:
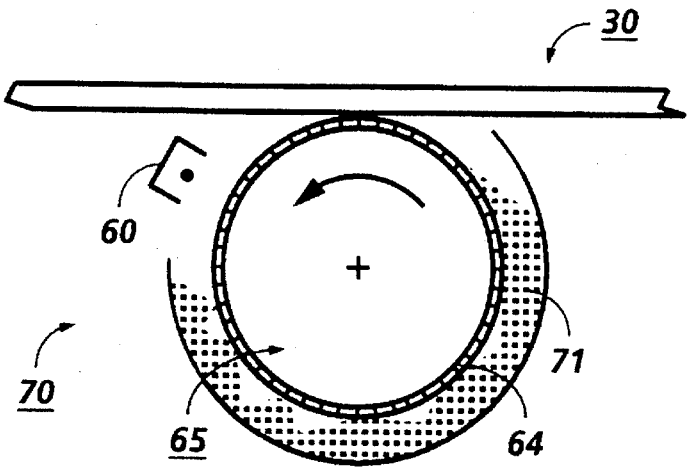

FIGS. 7A and B illustrate another embodiment for making and using a device of the instant invention.

Figure 8A:
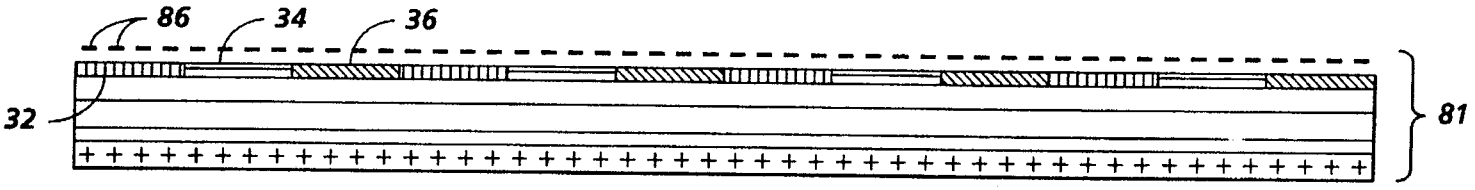

FIGS. 8A, B and C illustrate an embodiment for color imaging with a device of the instant invention.

Figure 9:
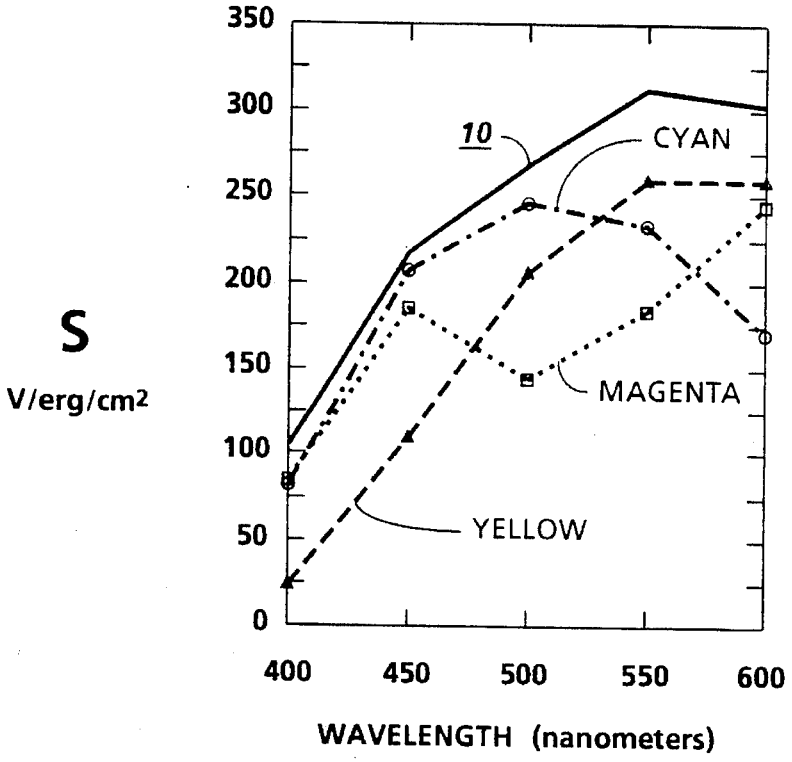

FIG. 9 illustrates an embodiment of color imaging with the device of the instant invention.

Figure 10:
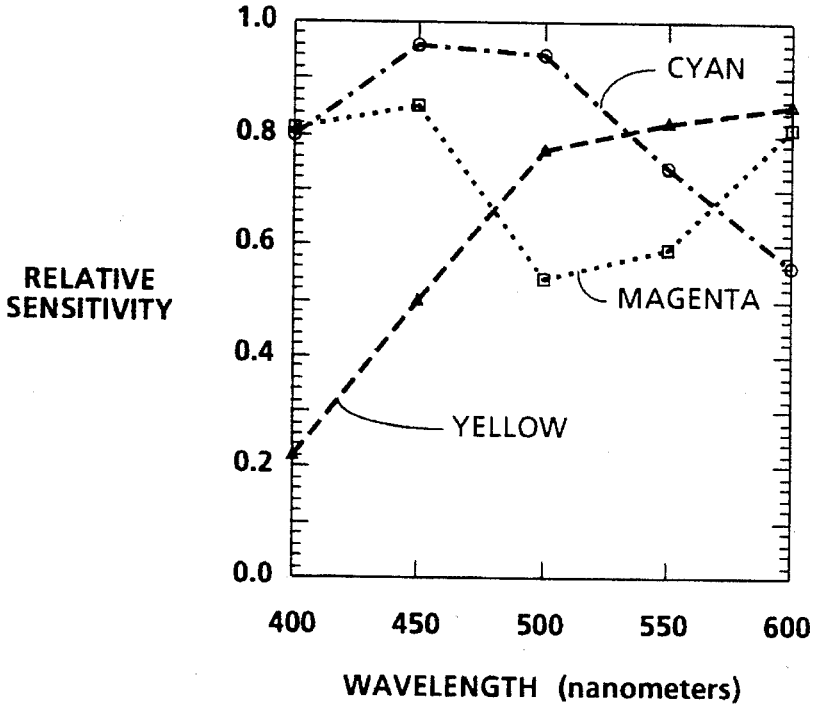

FIG. 10 illustrates an embodiment of color imaging with the device of the instant invention.

Figure 11:
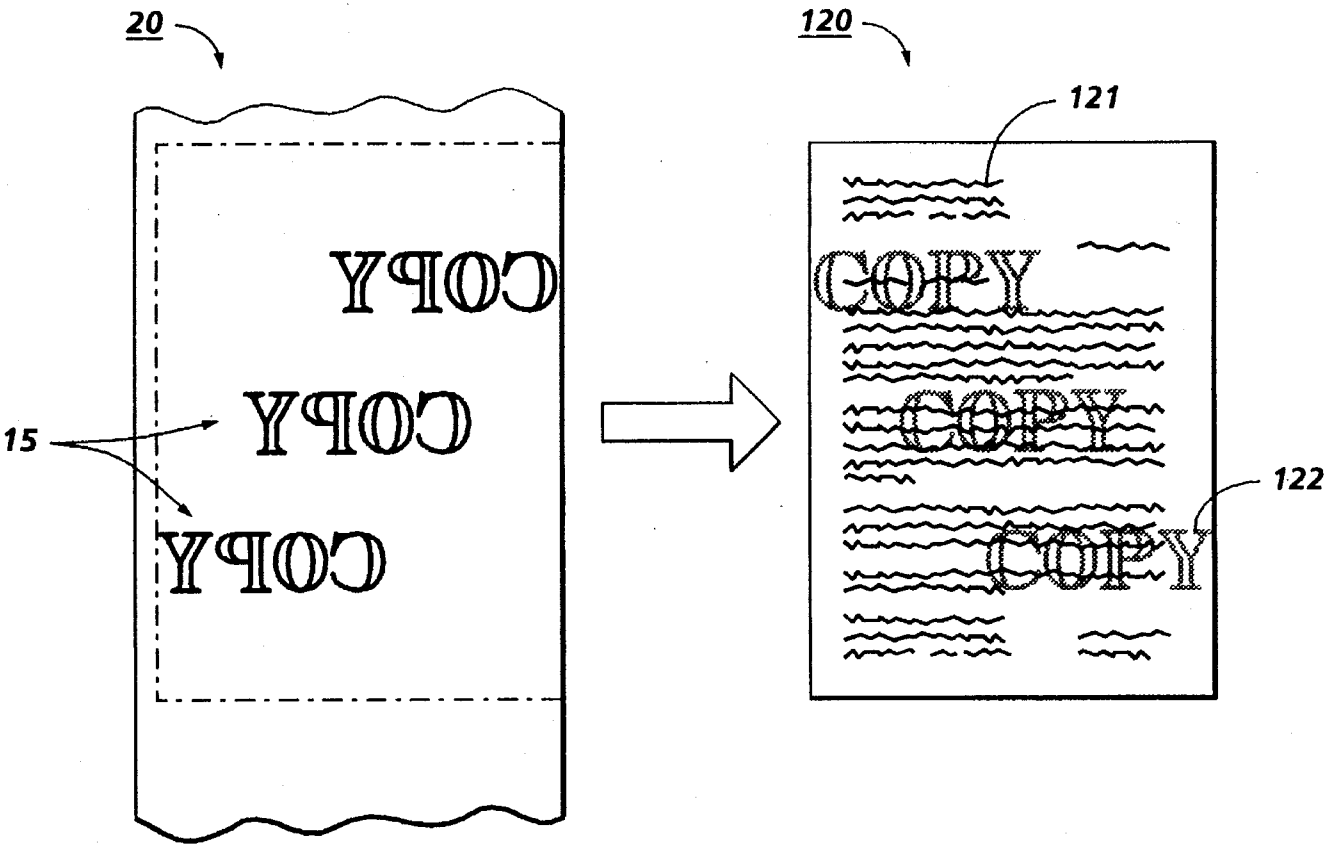

FIG. 11 illustrates an embodiment of imaging with the device of the instant invention.

These figures merely schematically illustrate the invention and are not intended to indicate relative size and dimensions of photoreceptor devices or components thereof.

DETAILED DESCRIPTION OF THE DRAWINGS

Figure 1:
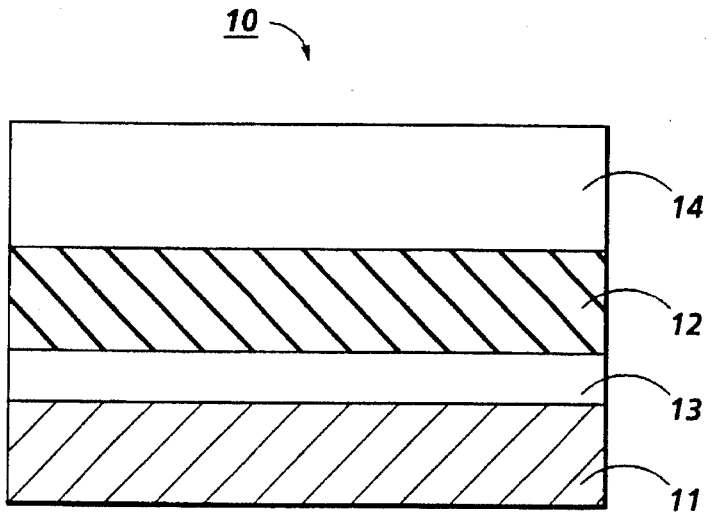
FIG. 1 PRIOR ART
FIG. 1 is a schematic illustration of one embodiment of a conventional prior art multilayer photoreceptor device.
Figure 2:
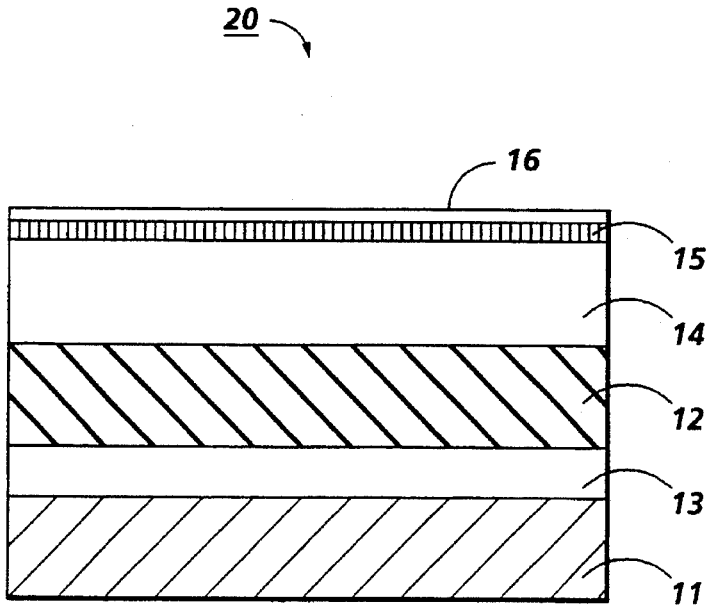
FIG. 2 illustrates an embodiment of a multilayer photoreceptor device of the instant invention.
Figure 3:
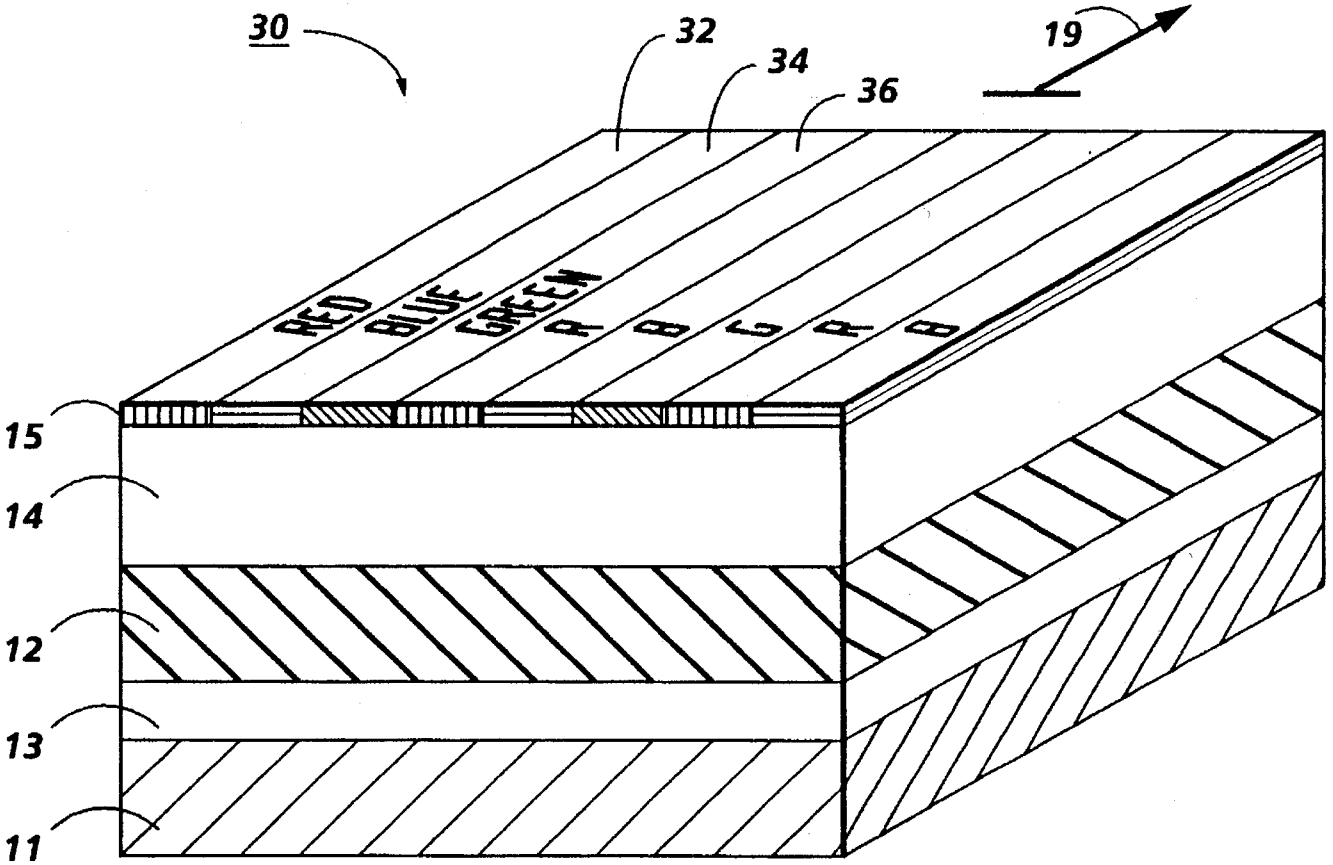
FIG. 3 illustrates still another embodiment of a multilayer photoreceptor device of the instant invention.
Figure 4:
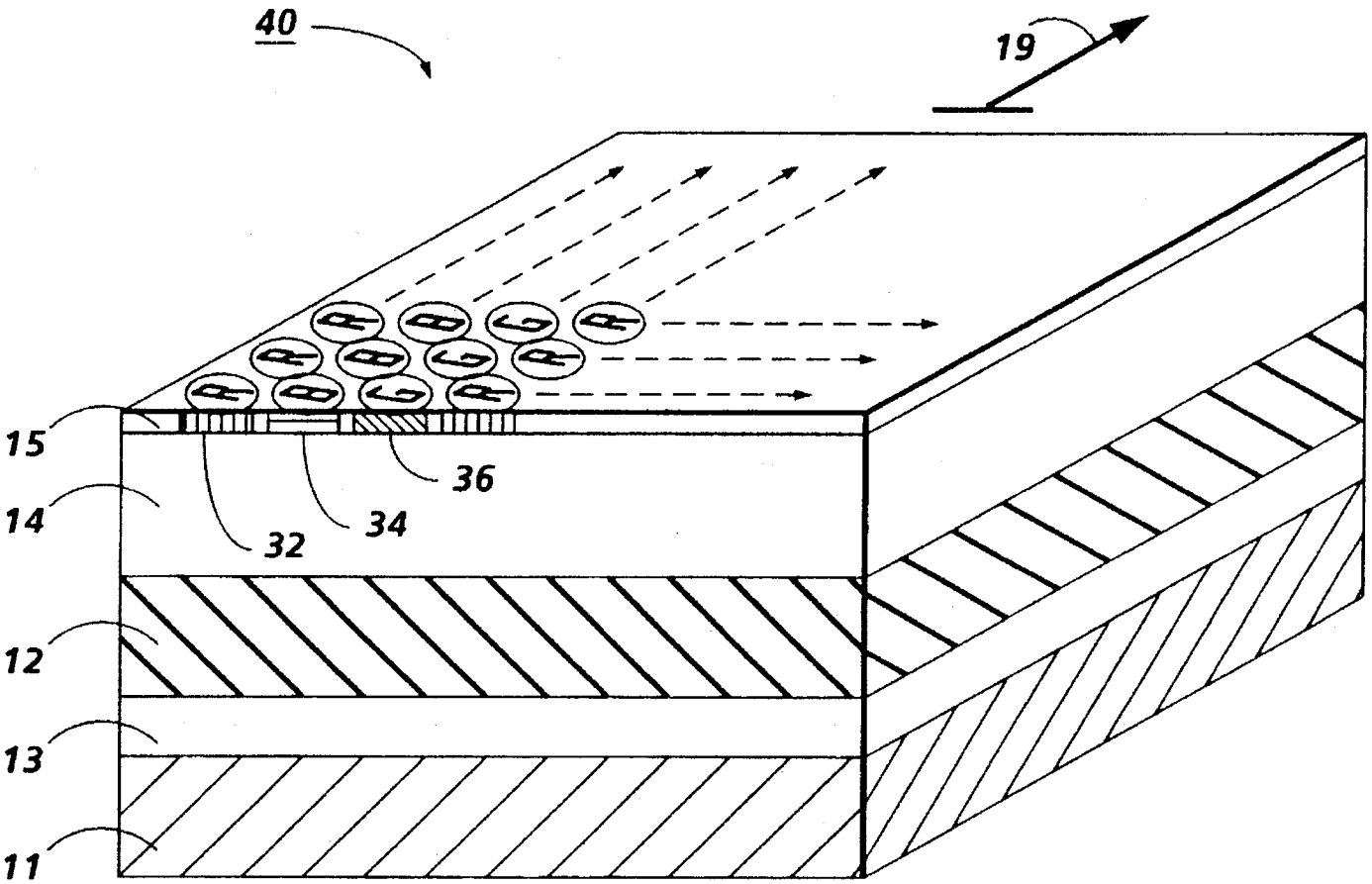
FIG. 4 illustrates another embodiment of a multilayer photoreceptor device of the instant invention.

In the drawings, FIGS. 2–4 represent several embodiments of photoreceptor devices within the scope of the present invention. The devices are all similar in that they comprise a substrate, an optional blocking layer thereon, a charge generation layer thereon, and a charge transport layer over the generation layer. The prior art photoreceptor 10 shown in FIG. 1, comprises a substrate 11; a charge generation layer 12 comprising a photoconductive material homogeneously dispersed in an electrically insulating organic resin; a blocking layer 13 to prevent injection of charge carriers from the substrate into the charge generation layer 12; and a charge transport layer 14 comprising a transparent electrically inactive resin having dissolved or dispersed therein one or more known charge transport molecules.

In FIG. 2, photoreceptor 20 of the present invention differs from the embodiment of FIG. 1 in that the surface of the charge transport layer 14 has been modified by the action of the sublimed disperse dye transfer process wherein the resulting mixture of materials from the upper zone of transport layer 14 and disperse dye produces a thin film hybrid layer 15 for spectral filtering. More specifically, thin film hybrid layer 15 comprises electrically insulating resin the aforementioned charge transport materials and molecularly dispersed dye molecules. The thin film hybrid layer 15 may be optionally coated with a suitable protective overcoat composition to form an overcoat layer 16, for greater mechanical integrity and stability.

FIGS. 3 and 4 show examples of color imaging member embodiments of the present invention wherein two or more, preferably three, different sublimed dyes are patterned in such a way as to achieve: in the case of FIG. 3, a color imaging member 30, having a plurality of closely spaced colored regions resembling striped panels, for example 32, 34, and 36, whose color pattern repeat sequentially and are further perpendicular or diagonal and preferably parallel in the long direction to the process direction 19 of the operational filtered photoreceptor color imaging member 30, with said panels having substantially different spectral sensitivities in the visible spectrum; and in the case of FIG. 4, a color imaging member 40, having a plurality of closely spaced and substantially circular colored regions, for example 32, 34, and 36, resembling a half toned dot pattern, with the different colored dyed dot patterns having substantially different spectral sensitivities in the visible spectrum. The dye modified filtered photoreceptor regions 32, 34, and 36 represent, for example, the dye colors or corresponding spectral sensitivities red or R, blue or B, and green or G, respectively. Thus, selective dye sublimation or diffusive transfer may be used to create one or more color filter areas in conventional organic or inorganic photoreceptors comprising a polymeric film forming binder.

Figure 5:
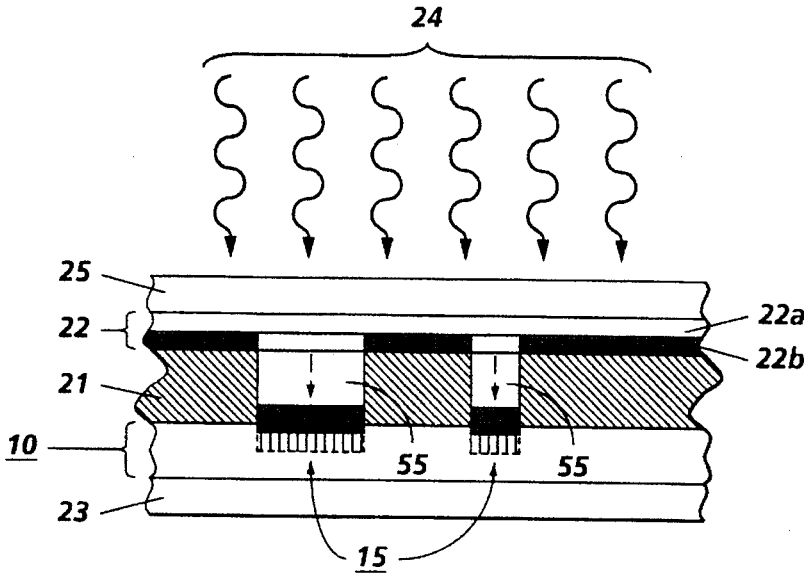
FIG. 5 illustrates an embodiment for making a device of the instant invention.

FIG. 5 illustrates an embodiment for the process of making filtered photoreceptors of the present invention. A conventional prior art photoreceptor 10 is supported and protected by protective sheet member 23, for example a paper sheet. The photoreceptor 10 is next covered by patterned masking member 21, comprised of for example, heat resistant metal, paper, plastic and the like. Masking member 21 contains openings 55 that define the desired resultant dyed filter pattern 15 on the photoreceptor 10. A dye donor member 22, such as a plastic sheet **22*a* loaded on one or both sides with sublimable dye material 22*b* and a second protective member 25, respectively, are placed atop the mask member 21. Heating the outermost protective member 25 with thermal means 24, for example a solid metal plate or a laser beam, causes the dye 22*b* contained on the dye donor member 22 in contact with the mask member to sublime. The gaseous sublimed dye molecules transgress through the mask member 21 only in those areas defined by the openings 55, whereby the gaseous dye molecules penetrate the outermost layer of the photoreceptor member 10 affording the patterned surface dye-resin hybrid layer 15. Variation in the specific techniques for applying the sublimable thermally transfered dye material to the existing outer most polymer coated layer of the photoreceptor, particularly differences in the geometry of the openings in the patterned mask member 21 lead to a variety of distinct internal filtering configurations as shown for example in the aforementioned FIGS. 3 and 4 which dictate their consequent applications as shown in FIGS. 6A and B and 7A and B. Alternatively, the mask member 21** may be omitted entirely in the fabrication process affording a photoreceptor that is uniformly coated and converted to a color filtered imaging member that is light selective according to the absorption sensitivity, characteristics of at least one dye.

Figure 6B:
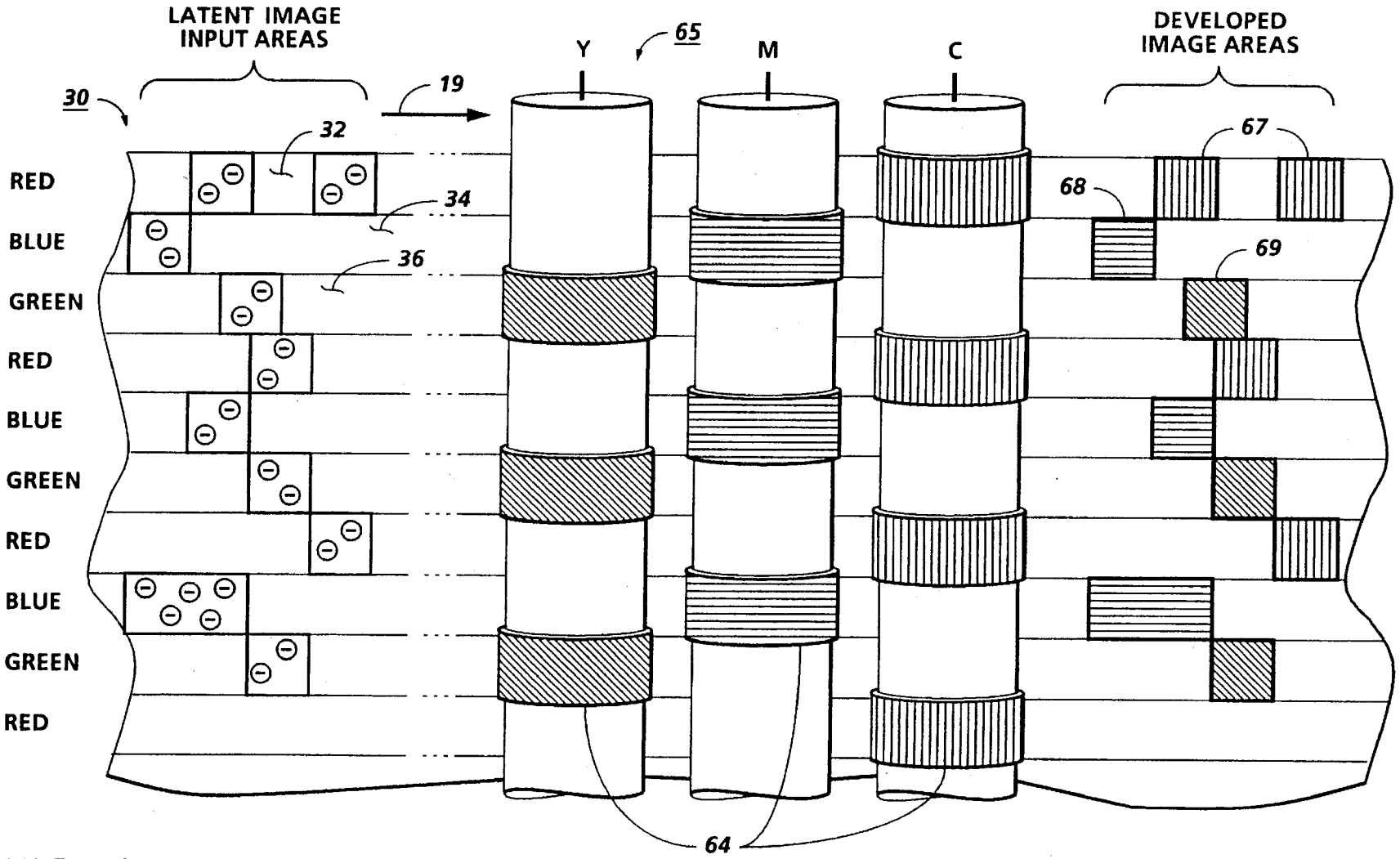

FIGS. 6A and 6B show a banded donor roll member 65 used to selectively load toner and deposit pixels, articulated bands or continuous bands of charged toner onto a filtered photoreceptor 30. Any suitable ribbed or banded donor roll 65 may be utilized, such as, for example, the donor rolls disclosed in U.S. Pat. No. 3,203,394, so long as it satisfies typical toner charging requirements described below. That is, the toner donor roll 65 is loaded with charged toner when the donor roll 65 is, for example, negatively charged by, for example, a corotron and the toner particles are triboelectrically positively charged by agitation in a developer housing allowing only protruding island areas or charging regions 64 of the donor roll 65 and not channel or relief valley areas 66 nor the non-developing end regions 63 at the ends of the donor roll 65 to load toner and subsequently donate charged toner to the oppositely charged sites on the receiving filtered photoreceptor member 30 so as to produce multi color prints in the xerographic process and apparatus of the instant invention. Donor rolls having a raised rib or post areas 64 of very small dimensions, for example, 10 to 100 micrometers wide, may be fabricated using lithographic and microlithographic techniques.

In FIG. 6B, a color imaging subsystem is shown utilizing a color imaging member 30 prepared by selective dye sublimation in which color filter areas are formed in the shape of strips, stripes or panels on a binder resin coated organic or inorganic photoreceptor. Different stripes 32, 34 and 36 on imaging member 30 represent different imbibed color dye filters. Depending upon the shape and colors of the activating radiation resulting from imagewise exposure, segments of, for example, a single pixel or an entire length of one or more stripes may remain charged after the uniform charging and exposure steps. Thus, in the selective development process shown in FIG. 6B, for example in the case of the "paneled" filtered photoreceptor configuration of color imaging member 30 of FIG. 3, the toner is taken up on at least one donor roll 65 only in the areas corresponding to the raised or post areas 64 on the donor roll. The dye filtered regions 32, 34, and 36 remain charged or become discharged according to the wavelength of the incident radiation and the absorbance characteristic spectral response of the hybrid dye imbibed polymer film layer. The preferred size of the filtered regions is between about 5 and about 20 micrometers, which size closely approximates the average toner resin particle size. The toner on island areas 64 is selectively deposited only to those charged regions that correspond to a complementary color scheme.

Figure 7B:
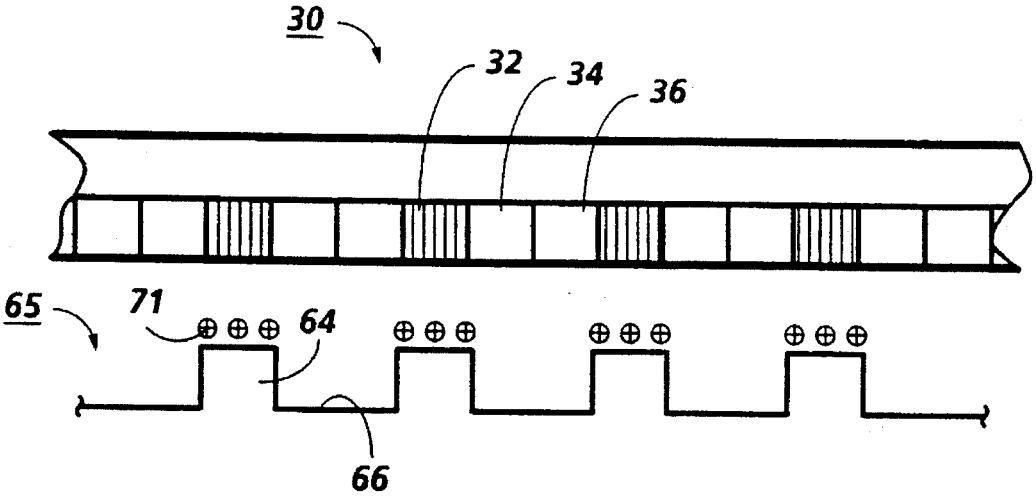

A preferred development system is shown in FIG. 7 and is modeled after the known toner development system 70, disclosed in U.S. Pat. No. 3,203,394, wherein the toner developer composition 71 loads onto the donor roll 65 according to the charge bias imparted upon it by the corotron 60. In the alternative, loading may be achieved with a known magnetic brush development system. The loaded charged toner 71 is brought into close contact with the photoreceptor 30 wherein development occurs on the photoreceptor 30 according to the electrostatic latent image formed on unexposed charged areas on the photoreceptor 30 that correspond to a particular dye color sensitivity. This means that either the dye absorbs some of the incident light or there is no light exposure in that area and therefore a charged pattern remains as the latent image. That is, for example, the stripes of toner on the cyan developer donor roll are precisely aligned with the appropriate dye imbibed filter pattern on the photoreceptor 30. Another alternative development system is described in U.S. Pat. No. 4,618,241 to Hays and Wayman. The disclosure of U.S. Pat. Nos. 3,203,394 and 4,618,241 is incorporated herein by reference in its entirety. By using multiple development substations 70 of the type shown in FIG. 7A, each applying a different color, color separation and xerographic color development can be achieved to the extent that the unexposed, filtered, charged areas on the photoreceptor discriminate and resolve imagewise the incident visible radiation. More specifically, if a particular filtered region is sensitive to the incident radiation, it will be discharged and subsequently will not be developed by the charged toner. If the filtered region is insensitive to the incident radiation, then this filtered region will remain charged and will be developed by a complementary colored toner. By alignment of the colored toner stripes or developer islands 64 on the donor rolls with the appropriate color filter stripes on the photoreceptor 30, the development substations can apply toner according to the sequence, for example: yellow, cyan then magenta to form a multicolored image. Generally, the smaller the dimensions of the filtered regions, for example of about 10 micrometers in diameter or width and the greater the dispersion of filtered regions, for example all adjacent filtered regions are of different color sensitivities, or in the alternative, no two adjacent filter regions are of the same color, color images of the highest quality can be produced. The combined elements of an imbibed color filter pattern in the film forming polymer continuous phase of a photoreceptor such as the photoreceptor illustrated in FIG. 3 and a controlled area development apparatus such as that shown in FIGS. 6A, 6B, 7A and 7B can perform a filtered color imaging process.

Figure 8B:
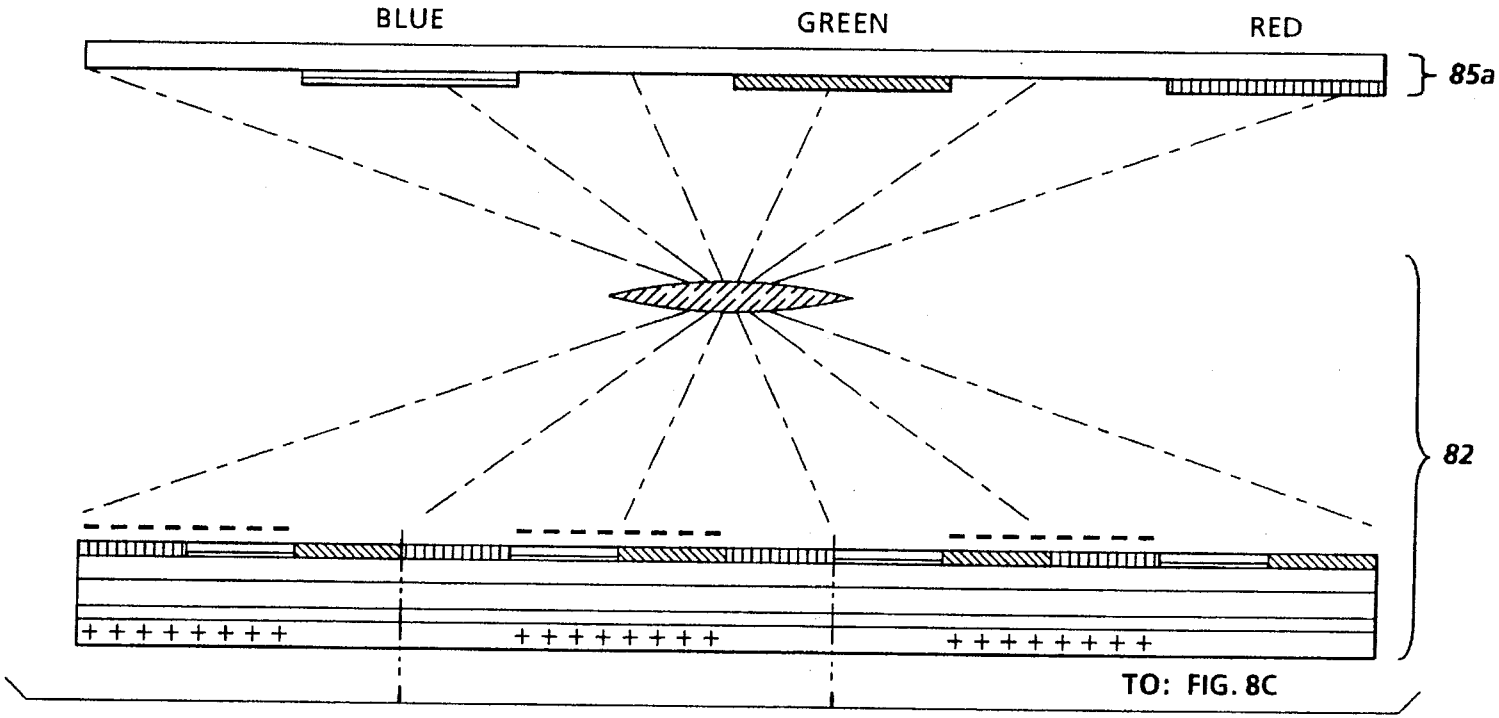
Figure 8C:
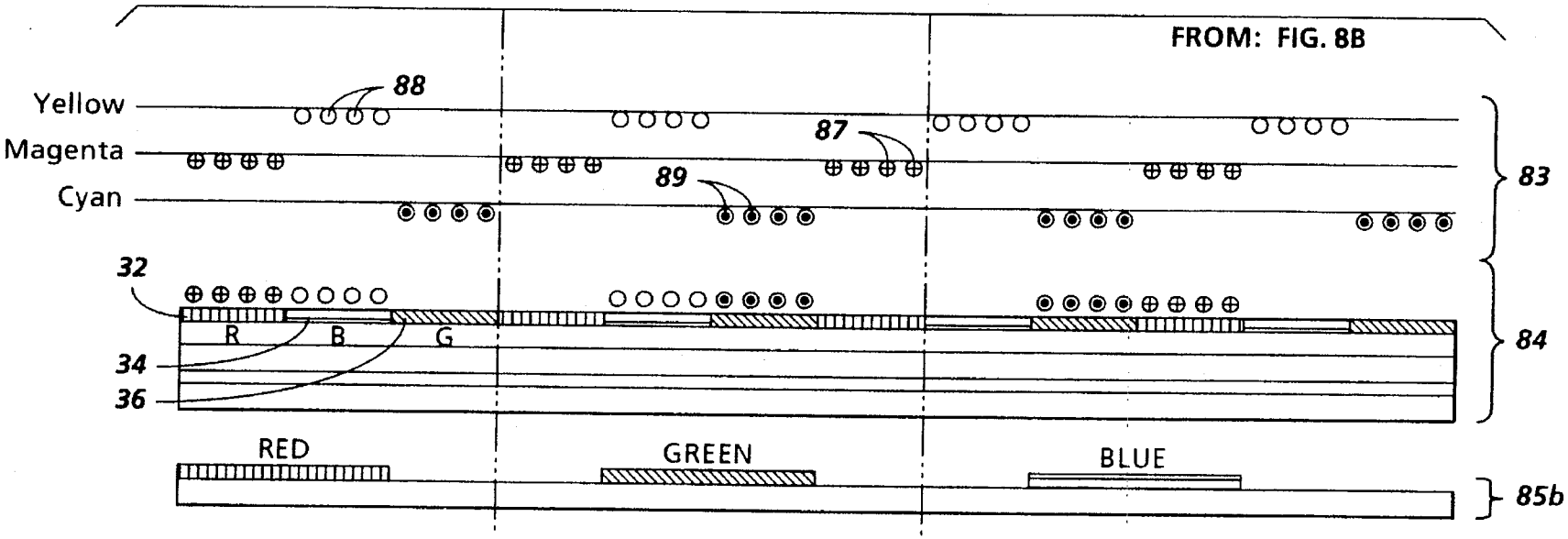

FIGS. 8A, 8B and 8C illustrate a method to accomplish a complete color imaging process using a single illumination exposure pass and a filtered photoreceptor of the instant invention. In FIG. 8A, a fully charged photoreceptor 81 is shown having a plurality of closely spaced colored dye imbibed regions resembling striped or patched panels 32, 34, and 36, whose color pattern repeat sequentially in the upper surface of a charge transport layer forming a multicolored spot or striped matrix. The imaging surface of the photoreceptor has received a uniform negative charge 86 by corona charging which induces an equal and opposite positive charge in the conductive substrate of the photoreceptor.

In the exposure step 82 shown in FIG. 8B, exposure of the charged photoreceptor to an original colored image 85*a* results in the discharging of charge overlying the closely spaced colored dye imbibed regions resembling striped or patched panels 32, 34, and 36 in those filtered regions which are sensitive to the incident radiation. The filtered regions 32, 34, and 36 insensitive to the incident radiation remain charged as shown by the negative charges remaining after exposure overlying these filtered regions.

The sequence of development steps 83 are symbolically shown in FIG. 8C where stripes or patches of magenta toner 87 carried on a donor surface, stripes or patches of yellow toner 88 carried on a donor surface, and stripes or patches of cyan toner 89 carried on a donor surface are sequentially applied to the corresponding charged portions of the colored dye imbibed regions resembling striped or patched panels 32, 34, and 36 on the photoreceptor. In other words, three separate/exclusive/sequential area development steps are utilized so that red dye imbibed areas of the photoreceptor are developed with cyan toner, green dye imbibed areas are developed with magenta toner, and blue dye imbibed areas are developed with the yellow toner. The developed photoreceptor 84 is shown with deposits of magenta 87, yellow 88 and cyan 89 toner. The developed toner images are transferred and fused to a receiving sheet 85*b* such as paper affording color images closely resembling the original color image 85*a*. Transfer and fusing may be accomplished by any suitable well known techniques such as electrostatic transfer and heat fusing, respectively. The developed toners preferably should flow together locally during the fusing step for improved print quality and color fidelity results. That is, dithering on a microscopic distance scale of, for example, from about 1 micrometer to about 100 micrometers, with mixing of different colored toner from adjacent developed regions readily occurs in the toner melt during fusing to expand the color gamut achievable by the filtered photoreceptors of the present invention enabling high quality multicolor images. Thus, selectively dye imbibed color filter areas and controlled area development are embodied in the process and apparatus shown in FIGS. 6A through 8C.

The spectral responses of photoreceptors having dyes diffused into their surfaces are represented in the graphs shown in FIGS. 9 and 10 and described in detail in Working Example IV below.

In yet another embodiment of the filtered photoreceptors of this invention, authentic original documents may be distinguished from copies that closely resemble the original document. In some instances it is useful to automatically identify copies as distinct from original prints. For example, a document which was first generated on a laser/raster output scanner printer would normally be difficult to distinguish from a xerographic copy of the same document. Another reason for distinguishing copies from originals would be to prevent or discourage copyright violations. A solution that achieves distinction between original documents and copied documents involves the use of a filtered photoreceptor device is shown in the FIG. 11. In this scheme the filtered photoreceptor of this invention is dyed, for example, in a pattern of yellow which will absorb enough blue light content from the exposure source to cause a low toner density print-out of the a desired "flag" pattern 122 on final prints 120, that is the patterned filtered photoreceptor regions 15 are a mirror image of, for example, the words "COPY", "CONFIDENTIAL", "UNAUTHORIZED COPY", "ILLEGAL COPY", "PROPERTY OF XYZ CORP" or "COMPANY LOGO" and the like and appear as legible background toner deposits 122 resembling a darkened watermark in appearance compared to the text 121 or other copied images on non-original prints 120. Both the color and saturation of the dye pattern in the filtered photoreceptor 20 may be adjusted so that the information content of the original document being copied would not be altered. The filtered photoreceptor regions of this embodiment must have spectral sensitivity in the "stop band" of the filtered areas 15. Also, the illumination source must include the "stop band" wavelengths.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A flexible photoreceptor was placed on the flat surface of a table with the imaging surface facing upwardly. The photoreceptor comprised a thin polyester substrate (Mylar, available from E. I. du Pont de Nemours & Co.), a siloxane interface layer, a polyester adhesive layer, a charge generating layer comprising trigonal selenium particles dispersed in polyvinyl carbazole and a charge transport layer comprising a diamine charge transport material dissolved in polycarbonate resin. A 3M Color-in-Color dye donor sheet from a 3M color copier, Model 137 BZ(1972) was placed against the exposed surface of the photoreceptor charge transport layer and the rear surface opposite the dye coated surface of the donor sheet was heated to about 177° C. (350° F.) with a hand iron for about 20 seconds to obtain a satisfactory transfer of the dye to the photoreceptor charge transport layer. The dye treated photoreceptor prepared in this manner was resistant to removal of the dye during solvent washing with, for example, water or isopropanol indicating that the dyes permeate into the transport layer. The ability to wash with isopropanol is very advantageous because this is a common solvent cleaner used to clean photoreceptors from time to time in copiers, duplicators and printers. Thus, the use of isopropyl alcohol during routine cleaning of the filtered photoreceptor would not be expected to damage or deteriorate the light filtering or charging properties of the device. The sublimation transfer process may be facilitated at reduced pressures in a conventional vacuum chamber having pressures in the range of about 10 to about $10^{-5}$ mm of mercury. Optionally, a primer coating may be applied on the transport layer to receive and to improve the adhesion of the transfer dye used. Further, a transparent and durable protective overcoating layer, for example Makrolon® may also be applied to the dye treated photoreceptor transport layer to prevent damage to the filtered photoreceptor from environmental and mechanical agents. The dye treated filtered photoreceptor exhibited an altered spectral response but otherwise retained comparable electrical properties to that of an untreated photoreceptor.

EXAMPLE II

A flexible photoreceptor was placed on the flat surface of a table with the imaging surface facing upwardly. The photoreceptor comprised a thin polyester substrate (Mylar, available from E. I. du Pont de Nemours & Co.), a siloxane interface layer, a polyester adhesive layer, a charge generating layer comprising trigonal selenium particles dispersed in polyvinyl carbazole and a charge transport layer comprising a diamine charge transport material dissolved in polycarbonate resin. A metal mask stencil consisting of about 0.076 mm (0.003 inch) thick stainless steel was placed between the photoreceptor imaging surface and a dye coated surface of a 3M Color-in-Color dye donor sheet from a 3M color copier, Model 137 BZ(1972) A similar assembly is illustrated in FIG. 5. The donor sheet was covered by a protective paper sheet. The exposed surface of the paper sheet was heated with a hot hand iron to about 121° C. 250° F.) during about 15 seconds. Upon cooling and removal of the paper, donor sheet and metal mask, the desired stencil dying pattern was observable by visual inspection of the absorption and transmission of visible light by the transport layer of the multilayered organic type photoreceptor.

EXAMPLE III

A flexible photoreceptor was placed on the flat surface of a table with the imaging surface facing upwardly. The photoreceptor comprised a thin polyester substrate (Mylar, available from E. I. du Pont de Nemours & Co.), a siloxane interface layer, a polyester adhesive layer, a charge generating layer comprising trigonal selenium particles dispersed in polyvinyl carbazole and a charge transport layer comprising a diamine charge transport material dissolved in polycarbonate resin. This photoreceptor was treated in one centimeter squares, and similar geometries, in separate regions with cyan, magenta, and yellow patches by a three step treatment of the photoreceptor with 3M Color-in-Color dyes with an equivalent area left untreated as a control. Electrical testing photo-responses were measured using controlled illumination source to determine $S=V/erg/cm^2$ at various wavelengths. Also, repeated cycling properties were found to be similar to undyed samples.

EXAMPLE IV

The aforementioned dyed filtered photoreceptor structure prepared using 3M Color-in-Color magenta, cyan and yellow materials add an untreated area as control as described in Example III was taped to a conductive support plate with grounding means. Negative charging was used in the Xerox Model D flat plate xerographic imaging apparatus and exposure was with a Xerox Number One camera having an incandescent photoflood exposure lamp. The spectral responses of photoreceptors having dyes diffused into their surfaces are represented in the graphs shown in FIGS. 9 and 10. The spectral sensitivity, shown as the vertical axis of FIG. 9, of the resultant filtered photoreceptor regions was measured in volts per ergs per square centimeters as a function of the exposure wavelengths of from 400 nanometers to 600 nanometers. The results are shown graphically in FIG. 9. The responses follow from the expected characteristics of the magenta, yellow, and cyan subtractive primary colors. That is, minus blue yellow leads to a low response at short wavelengths, minus green magenta leads to a low response at intermediate wavelengths and minus red cyan leads to low response at long wavelengths. The relative sensitivity of the filtered photoreceptor regions as a normalized percent of the undyed photoreceptor control area are shown graphically in FIG. 10. Other measurements made included the cycle-up and dark discharge parameters of the dye filtered photoreceptor. These parameters were found to be unchanged from the dye untreated photoreceptor control.

EXAMPLE V

The aforementioned dyed filtered photoreceptor structure prepared using 3M Color-in-Color magenta, cyan and yellow materials and an untreated area as control as described in Example III was taped to a conductive support plate with grounding means. Negative charging was used in the Xerox Model D flat plate xerographic imaging apparatus and exposure was with a Xerox Number One camera having an incandescent photoflood exposure lamp. Cascade development was used to develop the resulting images. The results were as follows: at four seconds exposure, imaging occurred after development with colored toners on all four sections of the filtered photoreceptor, that is in areas filtered with cyan, magenta, and yellow dyes, and an untreated control area; at one second exposure, again imaging occurred after development with color toners on all four sections of the filtered photoreceptor with slight loss of print resolution from the magenta dyed region while the yellow dyed region gave the best print result. In the longer exposure experiments, the cyan dyed region produced the best resolution in the prints. The print quality dependence upon exposure times is consistent with the aforementioned spectral response sensitivities of the dyed regions. More specifically, the incandescent illumination used in the exposure step causes the cyan dye to have the largest filter effect while the yellow dyed region has the smallest filter effect. That is, the yellow exposure optimum is less than the cyan exposure optimum. The filtered photoreceptor therefore retains its functionality as a xerographic photoreceptor.

Although the invention has been described with reference to specific preferred embodiments, it is not intended to be limited thereto, rather those skilled in the art will recognize the variations and modifications, including equivalents thereof, may be made therein which are within the spirit of the invention and within the scope of the claims.

What is claimed is:

1. An electrophotographic imaging method comprising providing an imaging member comprising a substrate, a unitary electrophotographic insulating layer which is electrically insulating in the dark and electrically conductive when struck by activating radiation and a continuous, substantially transparent film forming polymer phase, said layer having a surface facing away from said substrate, said surface facing away from said substrate comprising imbibed dye molecules, providing said surface facing away from said substrate with at least two sets of internal preformed dye color filter patterns, one of said sets of internal preformed dye color filter patterns having a different colored dye from the other set, forming a uniform charge on said imaging member, exposing said uniform charge on said imaging member in a single step to a multi-colored light image to discharge said imaging member in the non-image areas and to form at least one electrostatic latent image corresponding to a first of said sets of internal preformed dye color filtered patterns and at least one electrostatic latent image corresponding to a second of said internal preformed dye color filtered patterns, developing said electrostatic latent image corresponding to said the first of said sets of internal preformed dye color filtered patterns with marking particles of a second color to form a second toned image, said first and second toned images being formed in a single pass, and transferring in a single step said first toned image and said second toned image to a receiving member, and affixing said toned images to a receiving member to complete an imaging cycle.

2. An electrophotographic imaging method according to claim 1 wherein one of said sets of internal dye color filter patterns appears as permanent background character image on a limited area of said surface and the other of said sets of internal preformed dye color filter patterns is uniformly distributed on said surface.

3. An electrophotographic imaging method according to claim 1 wherein said latent images corresponding to one of said two dye colors is only contacted with marking particles of said first color to form said first toned image and said latent images corresponding to said second color of said two dye colors is only contacted with marking particles of said second color to form said second toned image.

4. An electrophotographic imaging method according to claim 1 including providing said surface facing away from said substrate with at least three sets of internal dye color filter patterns, each of said sets of internal dye color filter patterns having a different colored dye from the other sets, forming a uniform charge on said imaging member, exposing said uniform charge on said imaging member in a single step to a multi-colored light image to discharge said imaging member in the non-image areas and to form at least one electrostatic latent image corresponding to a first of said sets of internal dye color filtered patterns, at least one electrostatic latent image corresponding to a second of said internal dye color filtered patterns, and at least one electrostatic latent image corresponding to a third of said sets of internal dye color filter patterns, developing said electrostatic latent image corresponding to said first of said sets of internal dye color filtered patterns with marking particles of a first color to form a first toned image, developing said second of said sets of internal dye color filtered patterns with marking particles of a second color to form a second toned image, developing an electrostatic latent image corresponding to said third of said set of internal dye color filtered patterns with marking particles of a third color to form a third toned image, said first, second and third toned images being formed in a single pass, and transferring in a single step said first toned image, said second toned image and said third toned image to a receiving member, and affixing said toned images to a receiving member.

5. An electrophotographic imaging method according to claim 4 wherein said three dye colors are cyan, magenta, and yellow.

6. An electrophotographic imaging method according to claim 5 wherein said first latent image corresponding to said first color of said three imbibed dye colors is only contacted with marking particles of said first color to form said first toned image, said latent image corresponding to said second color is only contacted with marking particles of said second color to form said second toned image, and said latent image corresponding to said third color is only contacted with marking particles of said third color to form said third toned image.

7. An electrophotographic imaging method according to claim 4 including subjecting said imaging member to at least one additional imaging cycle.

8. An electrophotographic imaging method comprising providing an imaging member comprising a substrate and a unitary electrophotographic insulating layer, said unitary electrophotographic insulating layer consisting essentially of a single charge generating layer and a single charge transport layer which is electrically insulating in the dark and electrically conductive when struck by activating radiation, said charge transport layer comprising a continuous, substantially transparent film forming polymer phase, said polymer phase having a surface facing away from said substrate, said surface facing away from said substrate defining an outer boundary of at least one region within said polymer phase, said region comprising a solid solution of from about 0.01 percent and about 5 percent by weight of an imbibed vaporized or sublimed dye molecules, based on the total weight of said film forming polymer in said region, and subjecting said imaging member to an imaging cycle comprising forming a uniform charge said imaging member exposing said uniform charge imaging member in a single step to a light image to form at least one electrostatic latent image, developing said latent image with marking particles to form a toned image, transferring said toned image to a receiving member in a single step, and fixing said toned image to said receiving member.

9. An electrophotographic imaging method according to claim 8 wherein said surface facing away from said substrate is an exposed surface.

10. An electrophotographic imaging method according to claim 8 wherein said film forming polymer phase comprises polycarbonate.

11. An electrophotographic imaging method according to claim 8 wherein said surface facing away from said substrate is overcoated with a transparent protective layer.

12. An electrophotographic imaging method according to claim 8 wherein said surface facing away from said substrate defining an outer boundary of at least one region within said polymer phase, said region comprising a solid solution of from about 0.01 percent and about 5 percent by weight of an imbibed vaporized or sublimed dye molecules, based on the total weight of said film forming polymer in said region, said unitary photoconductive layer being coated with an overcoating layer comprising said a continuous substantially transparent film forming polymer phase.

* * * * *